US006193085B1

(12) United States Patent
Nook et al.

(10) Patent No.: US 6,193,085 B1
(45) Date of Patent: Feb. 27, 2001

(54) DISPENSING RACK

(75) Inventors: Thomas J. Nook, Grand Haven; William Russell Stone, Muskegon, both of MI (US)

(73) Assignee: Philip Morris, Inc., New York, NY (US)

( * ) Notice: Subject to any disclaimer, the term of this patent is extended or adjusted under 35 U.S.C. 154(b) by 0 days.

(21) Appl. No.: 09/244,634

(22) Filed: Feb. 4, 1999

(51) Int. Cl.[7] ..... A47B 47/00; A47F 1/00

(52) U.S. Cl. ..... 211/187; 211/59.3; 248/235

(58) Field of Search ..... 211/59.3, 59.2, 211/187, 189, 192; 248/221.11, 174, 235, 247; 312/263, 265.1, 265.2, 265.3; 108/106, 107, 108; 40/615, 617; 403/231, 363

(56) References Cited

U.S. PATENT DOCUMENTS

| | | | | |
|---|---|---|---|---|
| Re. 33,515 | * | 1/1991 | Fershko et al. | 211/59.2 X |
| D. 340,260 | | 10/1993 | Parker et al. | D20/19 |
| 3,310,899 | * | 3/1967 | Hart et al. | 40/617 X |
| 3,908,830 | | 9/1975 | Skrzelowski | 211/55 |
| 4,318,576 | * | 3/1982 | Ford | 312/264 |
| 4,324,379 | * | 4/1982 | Ovitz, III | 248/222.1 |
| 4,369,887 | | 1/1983 | Emery | 211/49 D |
| 4,406,374 | * | 9/1983 | Yedor | 211/192 |
| 4,557,064 | * | 12/1985 | Thompson | 40/617 X |
| 4,705,175 | * | 11/1987 | Howard et al. | 211/59.2 |
| 4,762,235 | * | 8/1988 | Howard et al. | 211/59.3 |
| 4,800,821 | | 1/1989 | Nook et al. | 108/111 |
| 4,875,590 | | 10/1989 | Martin et al. | 211/55 |
| 4,907,707 | * | 3/1990 | Crum | 211/59.3 |
| 4,915,460 | | 4/1990 | Nook et al. | 312/138.1 |
| 4,948,203 | * | 8/1990 | Amstrutz et al. | 312/265.3 X |
| 4,981,226 | * | 1/1991 | Shallenberg et al. | 211/189 |
| 5,014,862 | * | 5/1991 | Bustos | 211/189 X |
| 5,040,688 | | 8/1991 | Martin et al. | 211/55 |
| 5,088,607 | * | 2/1992 | Risafi et al. | 211/59.3 |
| 5,111,942 | * | 5/1992 | Bernardin | 211/59.3 |
| 5,269,597 | | 12/1993 | Yenglin et al. | 312/42 |
| 5,292,015 | | 3/1994 | Bumbera | 211/189 |
| 5,351,839 | * | 10/1994 | Beeler et al. | 211/59.3 |
| 5,427,255 | | 6/1995 | Nook | 211/187 |
| 5,439,123 | | 8/1995 | Nook | 211/187 |
| 5,494,246 | * | 2/1996 | McCarthy et al. | 248/221.11 |
| 5,564,579 | * | 10/1996 | Pynenburg et al. | 211/189 |
| 5,584,406 | * | 12/1996 | Besserer et al. | 211/189 |
| 5,749,478 | * | 5/1998 | Ellis | 211/59.2 |
| 5,820,289 | * | 10/1998 | Kern et al. | 403/231 |
| 5,931,554 | * | 8/1999 | Koopman | 312/405 |
| 5,975,663 | * | 11/1999 | Becker | 312/405 |

* cited by examiner

*Primary Examiner*—Daniel P. Stodola
*Assistant Examiner*—Erica B. Harris
(74) *Attorney, Agent, or Firm*—Van Dyke, Gardner, Linn & Burkhart, LLP

(57) ABSTRACT

A dispensing rack comprises a back panel joined to a pair of side panels by a pair of corner brackets, and a variety of shelf configurations, each of which enables products to be supported in a different orientation. Each corner bracket is formed with a channel dimensioned to accept an upright support therein. Each shelf configuration is provided with a pair of side support flanges having a plurality of fingers which are received by the apertures of the upright supports to thereby secure the shelves within the interior of the dispensing rack. A header member attached to the top region of the rack is provided with a translucent strip of material which attracts consumers' attention to the products positioned within the interior. A top cover has an upwardly arched surface to thereby prevent product from being placed thereon. Nesting of the upright supports within the interior of the corner brackets permits the entire interior of the rack to be utilized to support and display product.

15 Claims, 19 Drawing Sheets

DISPENSING RACK

BACKGROUND OF THE INVENTION

The present invention relates to dispensing racks, and in particular, to a dispensing rack for dispensing stackable articles such as tobacco products, photographic film, cassette tapes and the like.

Dispensing racks are frequently used in a variety of commercial retail environments in order to support and simultaneously display a variety of consumer goods. These dispensing racks are a common fixture in grocery stores, drug stores, department stores and other similar retail establishments as they provide a space effective means of supporting and advertising certain products. Such racks may be equipped to hold one or more types of product in a variety of different orientations. Some of the products frequently promoted and dispensed from these dispensing racks include photographic film, cassette tapes, video cassettes, and especially tobacco products, and in particular cigarettes.

Many prior art dispensing racks are composed of a large number of separate elements which require substantial time and effort to assemble and disassemble. Furthermore, many prior art dispensing racks, despite being relatively large, are incapable of supporting a large quantity of product because the structural configuration of the rack reduces the area in which product may be supported.

Frequently, these dispensing racks are moved to different locations within a single store for a variety of reasons. Such reasons include expansion of the store, particular promotional activities, or renovation of the store itself. During the time that the dispensing rack is being assembled and disassembled, it cannot serve its function of dispensing and promoting goods.

Additionally, the disassembly and reassembly at a separate location has a tendency to utilize a great deal of labor and disrupt normal store activities. Furthermore, assembly and disassembly of a dispensing rack conveys an image of clutter and increases the noise experienced by shoppers, thereby detracting from their shopping experience. Also, it is quite common that these dispensing racks are moved from one store to another or to a warehouse. Consequently, the ability to simply and efficiently assembly and disassemble a dispensing rack is a key feature and of great importance to its owner. A particularly successful dispensing rack having a structure which is easily assembled and disassembled may be found in U.S. Pat. No. 4,800,821 issued to Nook et al. on Jan. 31, 1989.

Another key feature of any dispensing rack is its ability to be reconfigured to accommodate more than one product having different dimensional characteristics, and to hold one or more products in different spatial orientations. The ability of a dispensing rack to be easily and quickly reconfigured to accommodate changing products specifications increases its value to the retailer. Still another key attribute of a dispensing rack is found in its ability to store a large number of products easily and efficiently.

Generally, it may be desirable to provide a dispensing rack which may be operated by store personnel while being inaccessible to consumers. Furthermore, it would be desirable to provide a dispensing rack capable of clearly displaying the product stored therein and thereby eliminate the need for additional advertising on the dispensing rack itself.

Consequently, there exists a need for a dispensing rack which is easily assembled and disassembled, and maximizes the space available for the support and display of product.

Furthermore, given the recent regulatory constraints placed upon the promotion and sale of tobacco products, there exists a need for a dispensing rack which can be operated by store personnel while being capable of displaying product in a variety of orientations to thereby maximize the consumer's perception of the advertising and promotional material contained on the product package.

SUMMARY OF THE INVENTION

Accordingly, one aspect of the present invention is to provide a unique shelf support for a dispensing rack wherein a pair of upright supports are nested within the frame of the dispensing rack. These upright supports are configured to receive shelf support members to hold the shelf securely in place. Nesting the upright supports within the frame enables the entire interior of the dispensing rack to be used in the support of product.

In a preferred embodiment, the shelf support comprises a pair of corner brackets, each of which is formed with a rear section and a side section. The rear sections of the corner brackets are connected by a back panel. Attached to each side section of the corner brackets is a side panel to thereby define the interior of the dispensing rack. Each rear section is formed having a vertical channel in communication with the interior of the dispensing rack. Each vertical channel is dimensioned to receive an upright support formed with a plurality of spaced apertures. These apertures are dimensioned to accept fingers projecting from the shelves to thereby hold the same in place. The nesting of the upright supports within the interior of the corner brackets permits the entire interior of the dispensing rack to be used to support product. Consequently, the dispensing rack is capable of receiving a greater quantity of product to thereby maximize space utilization.

Another aspect of the invention is to provide a modular dispensing rack construction which can easily and efficiently be assembled and disassembled. The modular rack assembly comprises a pair of side panels and a back panel connected by a pair of corner brackets to define an interior. A bottom assembly attached to the back panel and side panels has depending therefrom a leveling means to thereby permit the orientation of the dispensing rack to be adjusted for uneven flooring. A header is positioned within the upper region of dispensing rack and includes a means for supporting a lighting assembly to thereby enable the contents of the dispensing rack to be illuminated. A top cover is positioned over the dispensing rack to prevent unauthorized access to the products contained therein.

According to another preferred embodiment, the front of the dispensing rack is equipped with a pair of doors. The doors are attached to the bottom assembly and the header assembly and are each equipped with a lock to prevent unauthorized access to the products positioned within the interior of the dispensing rack.

According to yet another aspect of the invention, the front face of the header includes a strip or body of translucent material. This translucent material, which can be manufactured in any color, is illuminated by the lighting assembly and provides a visual stimulus to draw a consumer's attention to the products positioned within the dispensing rack.

According to yet another aspect of the invention, the top cover of the dispensing rack has an outwardly arched or convex shape. This convex shape prevents an operator from placing product upon the top of the dispensing rack and thus protects the aesthetic appearance of the dispensing rack.

Yet another aspect of this invention is to provide a dispensing rack capable of supporting a variety of shelves which support product in different orientations. In this embodiment, the dispensing rack supports at least one cascading rack which orients product at an acute angle. The dispensing rack may also include one or more spring loaded shelves which support individual products in a vertical orientation, and one or more promotional shelves which enable product to be stacked horizontally. Each of these shelves contain a pair of side support flanges having one or more fingers extending therefrom which are dimensioned for receipt by one of the plurality of apertures formed in the upright supports. By providing a dispensing rack which utilizes one or more of each of these shelves, the various types of advertising material contained on the product package is clearly accentuated and therefore the consumer's awareness of the products contained within the dispensing rack is heightened.

According to still another aspect of the invention, the spring loaded shelf contains a frame slidably attached to a pair of side support flanges dimensioned for receipt within the pair of upright supports positioned within the corner brackets. A spring loaded tray is positioned within the frame and is secured thereto by a securing assembly positioned on the undersurface of the spring loaded tray. The slidable spring loaded shelf can be moved to an extracted position wherein the shelf extends beyond the interior of the dispensing rack to enable the operator to easily stock the shelve with product, while the securing assembly prevents jarring of product as the spring loaded shelf is moved from the extended to the retracted position.

Yet another aspect of the invention is to provide a shelf locking assembly to permit the shelf to be locked within the interior of the dispensing rack. The locking assembly comprises a locking tab or clip slidably secured to each side support flange of a shelf. When the shelf is positioned within the interior of the dispensing rack such that the fingers are positioned within the apertures of the upright support, a force is exerted upon the locking clip to urge the same into one of the apertures occupied by the finger of the side support flange. The height of the locking clip corresponds approximately to the height of the aperture such that there is a frictional fit between the locking clip and the perimeter wall of the aperture. Once inserted within the aperture, the locking clip thereafter prohibits the rotational movement of the shelf and thus prevents extraction of the finger from the aperture. This in turn prevents removal of the shelf from the interior of the dispensing rack until the tab is removed from the aperture formed in the upright support.

The dispensing rack of the present invention may be used to support a variety of dispensable items such as, for example, photographic film, batteries and videocassettes. The dispensing rack of the present invention is particularly useful in the dispensement of tobacco products, especially cigarettes. The various aspects of the dispensing rack permit a retailer to increase the quantity of tobacco product supported by a single dispensing rack, while accentuating the advertising material carried by the products' packaging.

These and other features, advantages and objects of the present invention will be further understood and appreciated by those with ordinary skill in the art by reference to the following written specification, claims and appended drawings.

DETAILED DESCRIPTION OF THE PREFERRED EMBODIMENTS

Figure 1:
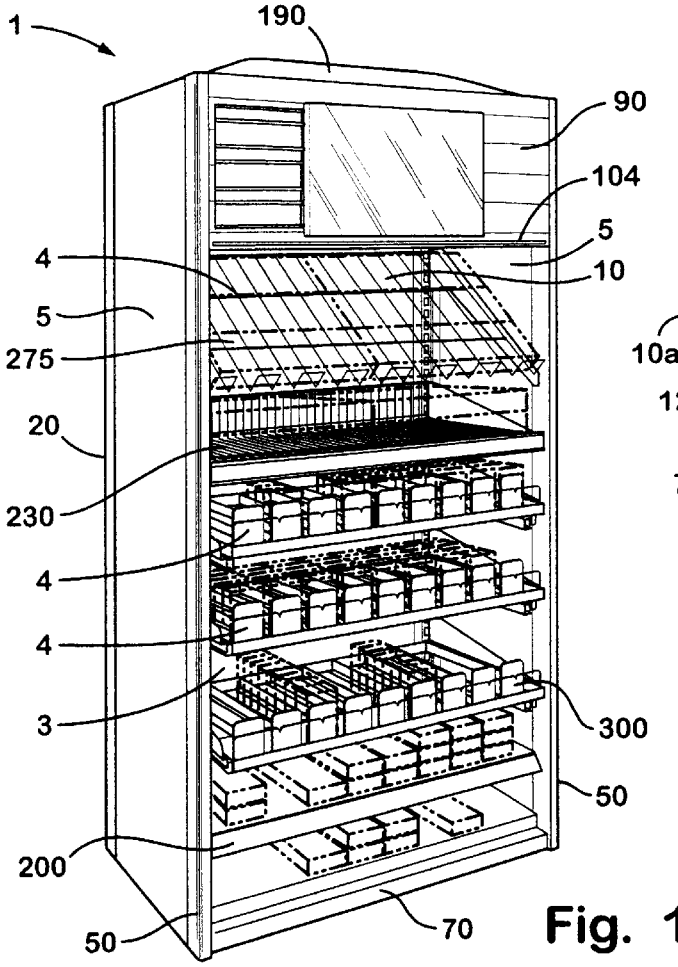
FIG. 1 is a perspective view of a dispensing rack according to the present invention.
Figure 3:
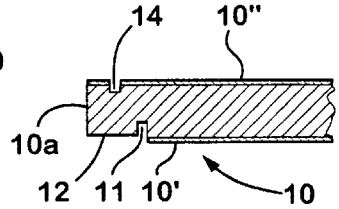
FIG. 3 is a fragmentary, top plan view of the back panel of the dispensing rack.
Figure 4:
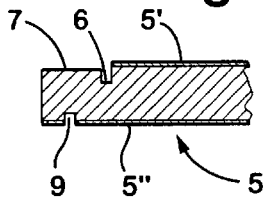
FIG. 4 is a fragmentary, top plan view of a side panel of the dispensing rack.
Figure 2:
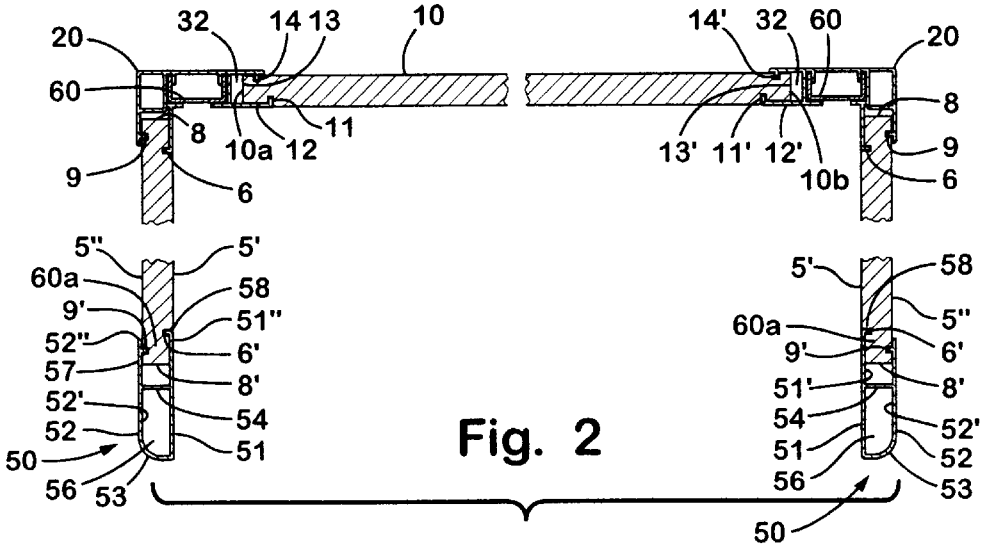
FIG. 2 is a fragmentary, horizontal, cross sectional view of the dispensing rack.
Figure 7:
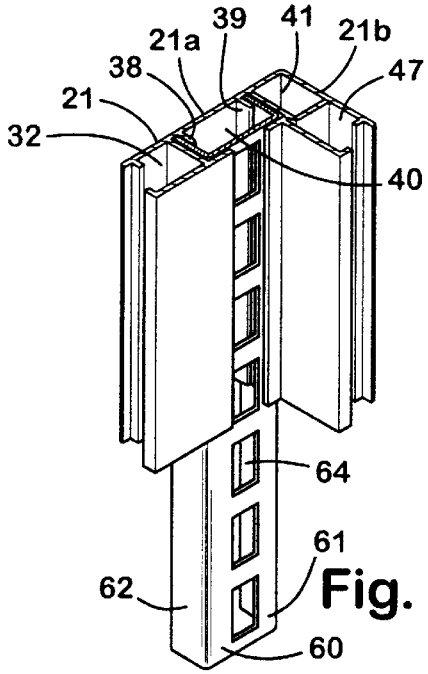
FIG. 7 is a perspective, fragmentary view of an upright support positioned within a corner bracket of the dispensing rack.
Figure 5:
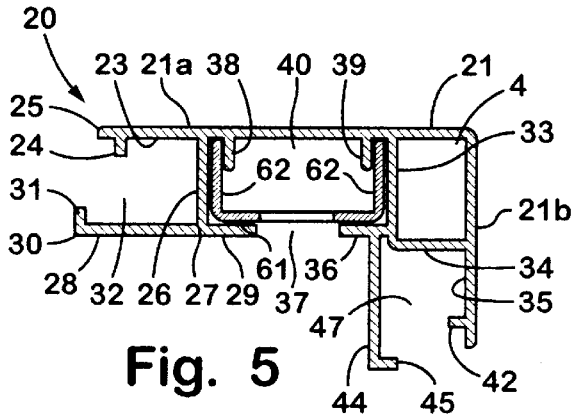
FIG. 5 is a horizontal, cross sectional view of an upright support positioned within a corner bracket of the dispensing rack.
Figure 6:
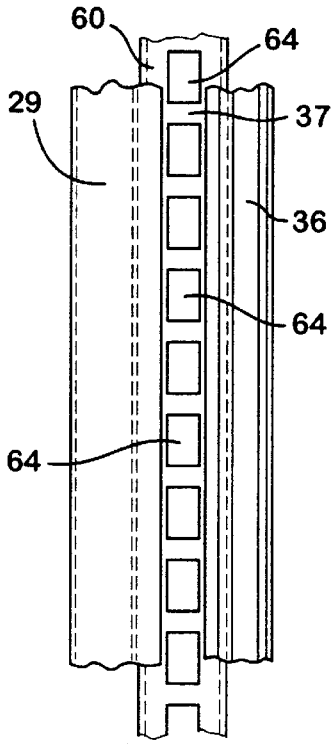
FIG. 6 is fragmentary, front view of an upright support positioned within a corner bracket of the dispensing rack.
Figure 11:
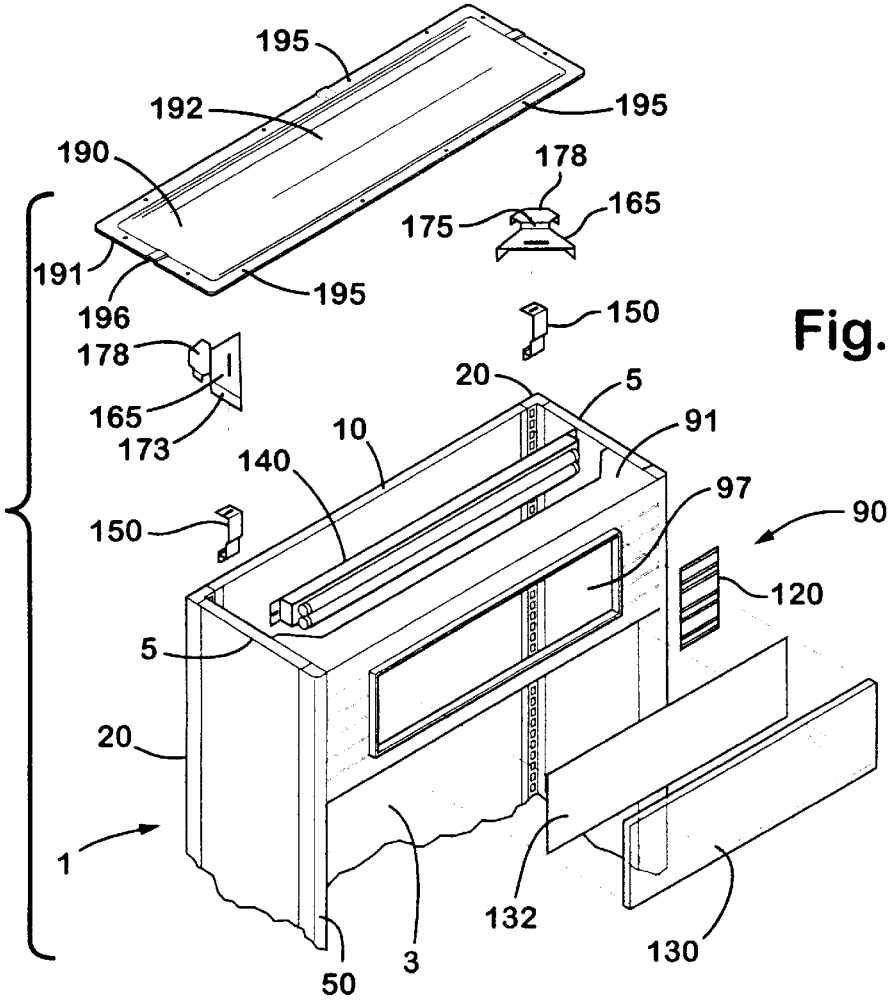
FIG. 11 is an exploded, fragmentary, perspective view of the top region of the dispensing rack.
Figure 12:
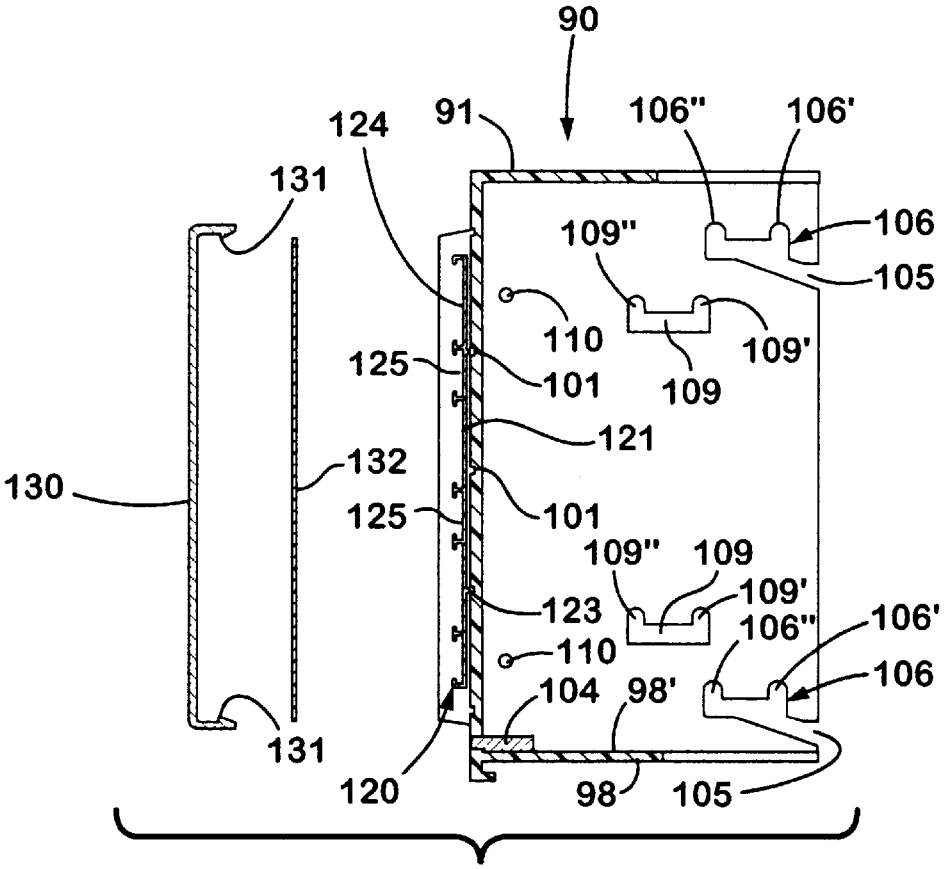
FIG. 12 is a partial cross sectional, exploded, side view of the header assembly of the dispensing rack.

Referring specifically to FIGS. 1 and 2, there is shown a dispensing rack according to the present invention and generally designated by reference numeral 1. Dispensing rack 1 may be manufactured in a variety of heights, depths and widths depending upon the particular application. Dispensing rack 1 comprises a back panel 10 joined by a pair of corner brackets 20 (FIG. 2). Each corner bracket 20 is attached to a side panel 5 and has positioned therein an upright support 60. Attached to ends 8' of side panels 5 are front brackets 50. A bottom assembly 70 is attached to the bottom of side panels 5 and back panel 10. Back panel 10, side panels 5 and bottom assembly 70 define interior 3 of dispensing rack 1, into which is removably secured a plurality of shelves 4, the details of which are described below. A header assembly 90, positioned within interior 3, is attached to side panels 5, while a light strip 140 (FIG. 11) is supported a preselected distance within interior 3 to thereby illuminate products residing within dispensing rack 1. Positioned atop header assembly 90, side panels 5, and back panel 10 is a top cover 190.

With reference to FIGS. 2–9, back panel 10 is a rigid, vertically oriented member having ends 10*a* and 10*b*. Preferably, back panel 10 is made of a polymeric material. Each corner bracket 20 has a generally L-shaped cross sectional configuration with an L-shaped outer member 21. Outer member 21 is further defined by a rear wall 21*a* and a side wall 21*b*, disposed in an orthogonal relationship. A rib 24 projects perpendicularly from inner surface 23 of rear wall 21*a* and is positioned a preselected distance from end 25. A first member 26, spaced a preselected distance from rib 24, projects perpendicularly from inner surface 23 of rear wall 21*a*. Attached to end 27 of first member 26 and extending orthogonally therefrom is a first flange 28, and a second flange 29. First flange 28 and second flange 29 extend in opposite directions. End 30 of first flange 28 is formed with a rib 31 extending towards inner surface 23 of rear wall 21*a*. Together, rear wall 21*a*, first member 26, first flange 28, and ribs 24 and 31 form a back panel connector 32 dimensioned to receive an end of back panel 10 as will be described in detail below.

A second member 33, positioned in spaced relation to first member 26 extends perpendicularly from inner surface 23 of rear wall 21*a*. Second member 33 is connected at its end to a third member 34 which extends from inner surface 35 of side wall 21*b*. Projecting orthogonally from second member 33 and towards second flange 29 is a third flange 36. Third flange 36 is spaced a preselected distance from second flange 29, thereby defining a slot 37 therebetween. A pair of ribs 38 and 39 extend from inner surface 23 of rear wall 21*a*, between first member 26 and second member 33. Ribs 38 and 39 are preferably formed such that the distance between rib 38 and first member 26 and the distance between rib 39 and second member 33 are approximately equal. Together, first member 26, second member 33, ribs 38, 39, second flange 29 and third flange 36 form a support channel 40 dimensioned to receive an upright support 60, as will be described in detail below. Second member 33, third member 34 and L-shaped outer member 21 define a corner channel 41.

A rib 42 extends orthogonally from inner surface 35 of side wall 21*b*. A fourth flange 44 extends substantially orthogonally from third flange 36. Fourth flange 44 projects in a direction away from rear wall 21*a* and contains at its end a rib 45. Rib 45 projects toward side wall 21*b*. Together, side wall 21*b*, fourth flange 44 and ribs 42, 45 define a side panel connector 47 dimensioned to receive a side panel 5.

Back panel 10 is formed having a front surface 10' and a rear surface 10". Front surface 10' of back panel 10 contains a pair of inwardly directed grooves 11, 11' and a pair of laterally positioned cut-out sections 12, 12' originating at ends 13, 13' and terminating at grooves 11, 11', respectively. Rear surface 10" is formed with a pair of inwardly directed grooves 14, 14' positioned proximate to end 13,13' respectively. As seen most clearly in FIG. 2, attachment of back panel 10 to corner brackets 20 is achieved by placing each end 13, 13' within a back panel connector 32. When so positioned, ribs 24 are received by grooves 14 and 14' while ribs 31 are positioned within grooves 11, 11' to thereby securely connect back panel 10 to corner brackets 20.

Each side panel 5 is formed having a front surface 5' and a rear surface 5". Front surface 5' of side panel 5 is formed with pair of inwardly directed grooves 6, 6' and laterally positioned cut-out sections 7, 7' originating at ends 8, 8' and terminating at groove 6, 6', respectively. Rear surface 5" is formed with a pair of inwardly directed grooves 9, 9' positioned proximate to end 8, 8', respectively. As seen most clearly in FIG. 2, attachment of a side panel 5 to a corner bracket 20 is achieved by placing end 8 within side panel connector 47. When so positioned, rib 42 is received by groove 9, while rib 45 is positioned within groove 6 to thereby securely connect a side panel 5 to a corner bracket 20.

Each front bracket 50 has an inner wall 51 and an outer wall 52 arranged in a generally parallel relationship and joined by an arcuate member 53. A transverse bridge member 54 is attached to inner surfaces 51' and 52' of inner wall 51 and outer wall 52, respectively. Inner wall 51, outer wall 52, arcuate member 53 and bridge member 54 define a front channel 56. Positioned proximate to end 52", and extending from inner surface 52', is a rib 57. A rib 58, projects from end 51" of inner wall 51, towards outer wall 52. Bridge member 54, inner wall 51, outer wall 52 and ribs 57, 58 define a side panel connector 60*a*.

Connection between a side panel 5 and a front bracket 50 is achieved by placing end 8' of side panel 5 within side panel connector 60*a*. When so positioned, rib 58 is received by groove 6' while rib 57 is positioned within groove 9' to thereby securely attach a side panel 5 to a front bracket 50.

Each corner bracket 20 receives an upright support 60 within support channel 40. Each upright support 60 comprises an elongated, rigid bar, having a C-shape when viewed in transverse cross section, with a front member 61 and a pair of side members 62 extending substantially orthogonally from front member 61. Front member 61 includes a plurality of apertures 64 formed therethrough. Apertures 64 extend along the length of upright support 60, and are placed in regular intervals, with each aperture 64 preferably having a rectangular shape.

When assembled, each upright support 60 is nested within a corner bracket 20 such that upright support 60 is received within a support channel 40 of a corner bracket 20 with side member 62 positioned between first member 26 and rib 38 and side member 62 positioned between second member 33 and rib 39. Placement of upright support 60 in this manner prevents lateral movement of upright support 60 within corner bracket 20. When positioned within corner bracket 20, front member 61 is positioned proximate to flanges 29 and 36 of corner bracket 20 such that apertures 64 are in communication with slot 37 and thus interior 3 of dispensing rack 1. The nesting of upright supports 60 within support channels 40 of corner brackets 20 permits the entire interior 3 of dispensing rack 1 to be used for supporting product.

Figure 8:
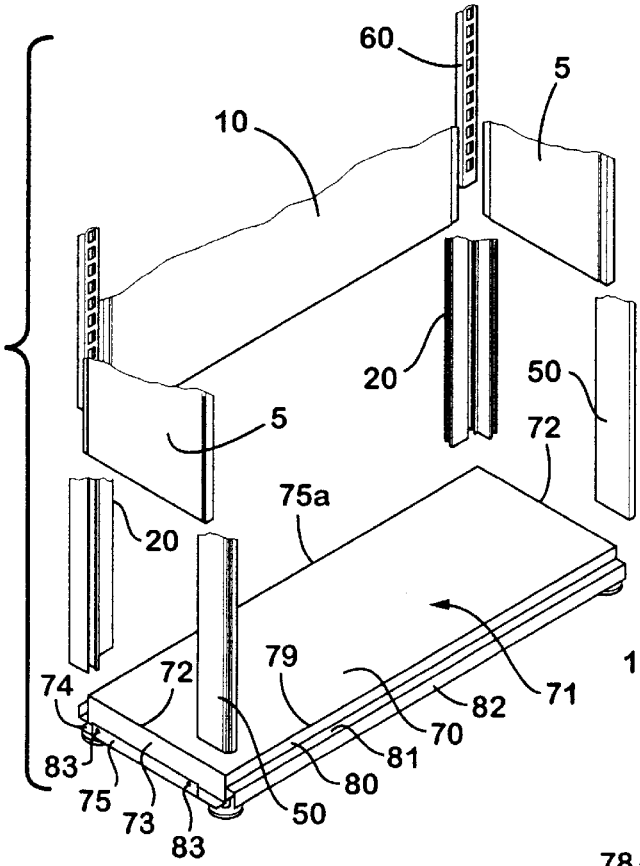
FIG. 8 is an exploded, fragmentary view of the bottom region of the dispensing rack.
Figure 9:
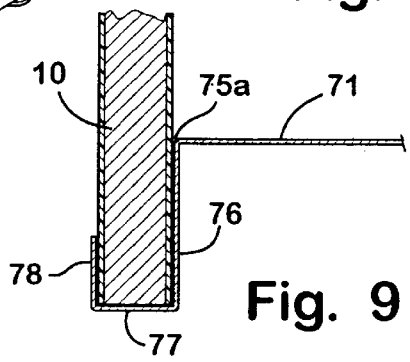
FIG. 9 is detailed, cross sectional side view of the back of the bottom assembly with the back panel positioned therein.
Figure 10:
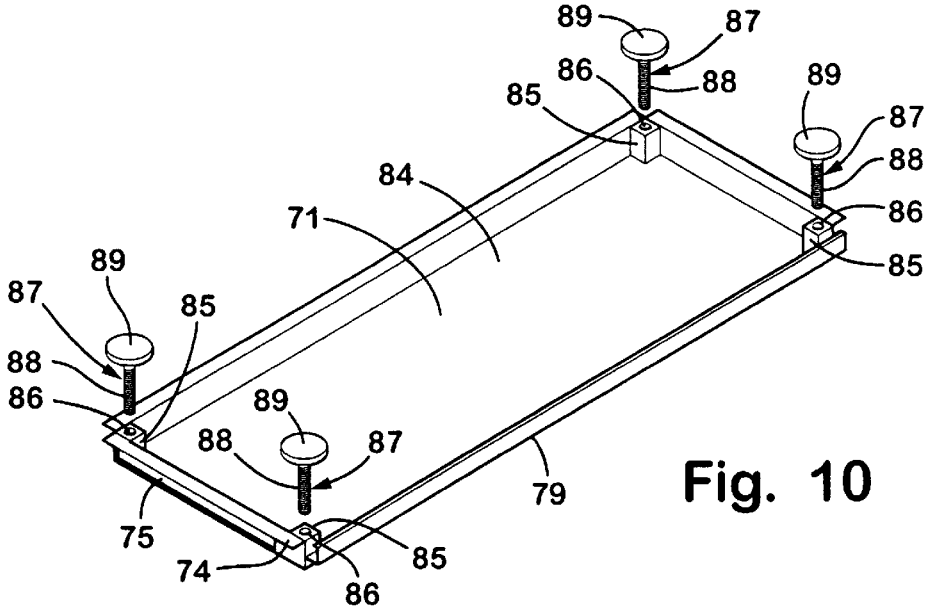
FIG. 10 is an exploded, bottom view of the bottom assembly of the dispensing rack.

Referring now to FIGS. 8–10, bottom assembly 70 includes a raised floor 71 having side walls 73 depending orthogonally from opposing sides 72. Each side wall 73 is formed having a substantially horizontal ledge 74 attached to an upturned flange 75. Back 75*a* of bottom assembly 70 is formed with a depending rear wall 76 having a horizontal ledge 77 and an upturned flange 78, while front 79 of bottom assembly 70 is formed with a depending front wall 80. Extending from front wall 80 is a horizontal ledge 81 attached to a downturned flange 82.

To attach bottom assembly 70 to dispensing rack 1, each side panel 5 is positioned between a side wall 73 and a upturned flange 75 such that the bottom of side panel 5 is placed in abutting contact with horizontal ledge 74. Thereafter, securement is achieved between side panel 5 and bottom assembly 70 by driving screws (not shown) or equivalent fasteners through holes 83 formed in upturned flange 75. Similarly, back panel 10 is attached to bottom assembly 70 by placing back panel 10 between rear wall 76 and upturned flange 78 and driving screws through holes (not shown) formed in upturned flange 78.

Referring now to FIG. 10, attached to undersurface 84 of raised floor 71 is a plurality of blocks 85, each of which has a threaded channel 86 formed therein. Each threaded channel 86 is dimensioned to receive a leveler 87. Leveler 87 includes a threaded shaft 88 attached to a disc 89 to thereby permit rotational adjustment of leveler 87 within block 85. Consequently, when positioned on an uneven surface, levelers 87 may be rotatably adjusted within blocks 85 to thereby ensure proper orientation of dispensing rack 1.

With reference to FIGS. 11–16, header assembly 90 includes a header member 91, a singage panel 120 and a transparent cover 130. Header member 91 comprises a front 92, a top 96, bottom 98 and opposing sides 100. Top 96 is formed having a mid-section 96' and slanted ends 96". A window 97 having a generally rectangular shape is formed in front 92. Positioned about the perimeter of window 97, and projecting from front 92 is a ledge 98*a*. Ledge 98*a* includes a plurality of grooves 99 (FIGS. 13 and 14) which receive tabs 131 formed in transparent cover 130 to thereby secure transparent cover 130 to ledge 98*a*. Disposed between transparent cover 130 and ledge 98*a* is a signage sheet 132. Preferably, signage sheet 132 is translucent and contains advertising indicia of the particular owner or operator of dispensing rack 1.

A plurality of horizontal grooves 101, formed in front 92, are dimensioned to receive horizontal ribs 123 projecting from rear surface 121 of signage panel 120. A plurality of horizontal tracks 125 extend from front surface 124 of signage panel 120 and permit an operator to removably place therebetween, for example, signage indicative of the cost of product positioned within interior 3 of dispensing rack 1. Signage panel 120 is secured to front 92 of header member 91 by any adhesive commonly employed in the industry.

A translucent body 104 is positioned on inner surface 98' of bottom 98. Translucent body 104 is preferably a strip of polymeric material having a thin, elongated rectangular shape. Translucent body 104 extends through a cut out 104*a* formed in front 92 of header member 91. When illuminated by light strip 140, translucent body 104 is clearly visible to persons facing front 92 of header member 91, thereby providing a visual stimulus which attracts one's attention to products residing within interior 3 of dispensing rack 1.

Each side 100 of header member 91 includes a pair of upwardly angled cut out sections 105 which lead to C-shaped cut outs 106. Each C-shaped cut-out 106 includes a pair of upwardly extending annular sections 106' and 106". To secure header member 91 to dispensing rack 1, header member 91 is placed within interior 3 of dispensing rack 1. Thereafter, bolts 107 or equivalent fasteners are placed in the forward most annular sections 106" of C-shaped cut outs 106 and driven into side panels 5. Each side 100 also includes a second set of C-shaped cut outs 109, which also have a pair of upwardly extending annular sections 109' and 109" and a pair of through holes 110 which also receive screws or like fasteners 110. When secured, front 92 of header member 91 is approximately flush with the front of dispensing rack 1, while ledge 98*a* projects beyond the front face of dispensing rack 1. Furthermore, when attached, top 96 of header member 91 is approximately coplanar with the top of side panels 5 and back panel 10.

Light strip 140 resides between header member 91 and back panel 10, and depends a preselected distance within interior 3 of dispensing rack 1. Light strip 140 may be any lighting means commonly employed in the industry capable of producing the requisite degree of illumination required by the particular application. When activated, light strip 140 illuminates signage sheet 132 positioned in window 97, translucent body 104, and the products positioned within the interior 3 of dispensing rack 1.

A pair of light support brackets 150, attached to a pair of corner gussets 165, support light strip 140 a preselected distance within interior 3 of dispensing rack 1. Each corner bracket 150 includes a horizontal member 152 formed with a upstanding lip 153 which abuttingly contacts the interior surface of back panel 10. Attached to the opposing end of horizontal member 152 is a generally L-shaped member 154 contoured to abuttingly contact rear surface 141 of light strip 140. A throughhole (not shown), formed in L-shaped member 154, is dimensioned to receive a threaded shaft extending from rear surface 141 of light strip 140. A bolt 156 is secured to the shaft to thereby secure light strip 140 to light support bracket 150. A vertical member 158 extending from L-shaped member 154 is formed with a horizontal ledge 160 through which a nut and bolt assembly 161 is threaded to secure light support bracket to corner gusset 165.

Each corner gusset 165 is composed of a lower section 168 which depends a preselected distance within interior 3 of dispensing rack 1. Ends 169, 169' of lower section 168 are cut at an angle with respect to front 170 such that front 170 of lower section 168 has a greater length than rear 172. Depending orthogonally from each end 169, 169' is a vertical member 173 which is positioned flush against the interior of back panel 10 and side panel 5. Each vertical member 173 contains at least one aperture through which a screw 173' is placed and driven into back panel 10 and side panel 5 to thereby secure corner gusset 165 to dispensing rack 1. Lower section 168 is also formed with a slot 170" through which nut and bolt assembly 161 is positioned.

A connector member 175, extending from rear 172, connects lower section 168 to upper section 178 of corner gusset 165. Upper section 178 is dimensioned to lay over the top of side panel 5 and back panel 10 and is formed with a pair of vertical members 179, 179' depending from sides 175'. When in position, vertical members 179 and 179' are flush against the outer surface of side panel 5 and back panel 10, respectively.

Top cover 190, attached to the top of side panels 5, rear panel 10 and header member 91, includes a generally flat perimeter 191 and a curved or arched middle section 192. Preferably, arched middle section 192 curves outwardly, away from dispensing rack 1. Arched middle section 192 of top cover 190 prevents personnel from placing product on top cover 190, and thereby serves to maintain the aesthetic appearance of dispensing rack 1. To attach top cover 190 to dispensing rack 1, screws (not shown) or like fasteners are inserted in throughholes 195 positioned about perimeter 191 and tightened within side panels 5, back panel 10 and header member 91.

Figure 17:
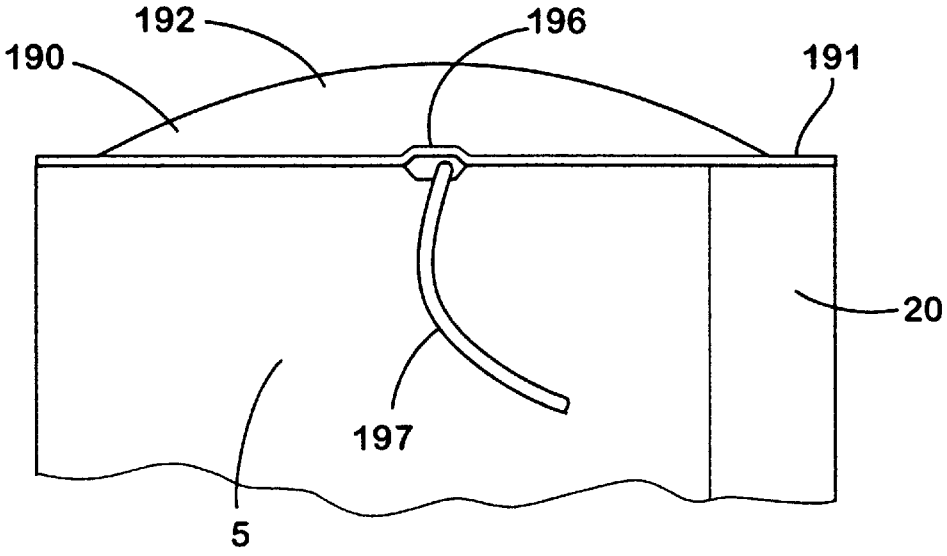
FIG. 17 is a side view of the dispensing rack depicting the side of the top cover.

As shown in FIG. 17, in a preferred embodiment, perimeter 191 of top cover 190 is formed with an upwardly arched lip 196. Arched lip 196 provides a passage for the electrical cable 197 attached to light strip 140 positioned within dispensing rack 1.

As illustrated in FIG. 1, dispensing rack 1 receives and supports a plurality of different shelves 4 which support and display product in a variety of different spatial orientations. Specifically, dispensing rack 1 may include one or more of the following removable shelves: a flat shelf 200, a promotional shelf 230, a cascading shelf 275, and a spring loaded shelf 300.

It is important to recognize that these shelves may be removably positioned in interior 3 of dispensing rack 1 in a variety of different arrangements. The ability of the shelves to be facilely arranged and rearranged is of great advantage because it enables the retailer to reconfigure the shelves so as to maximize the quantity of product stored, while utilizing the product's promotional material as a means of advertising.

Figure 18:
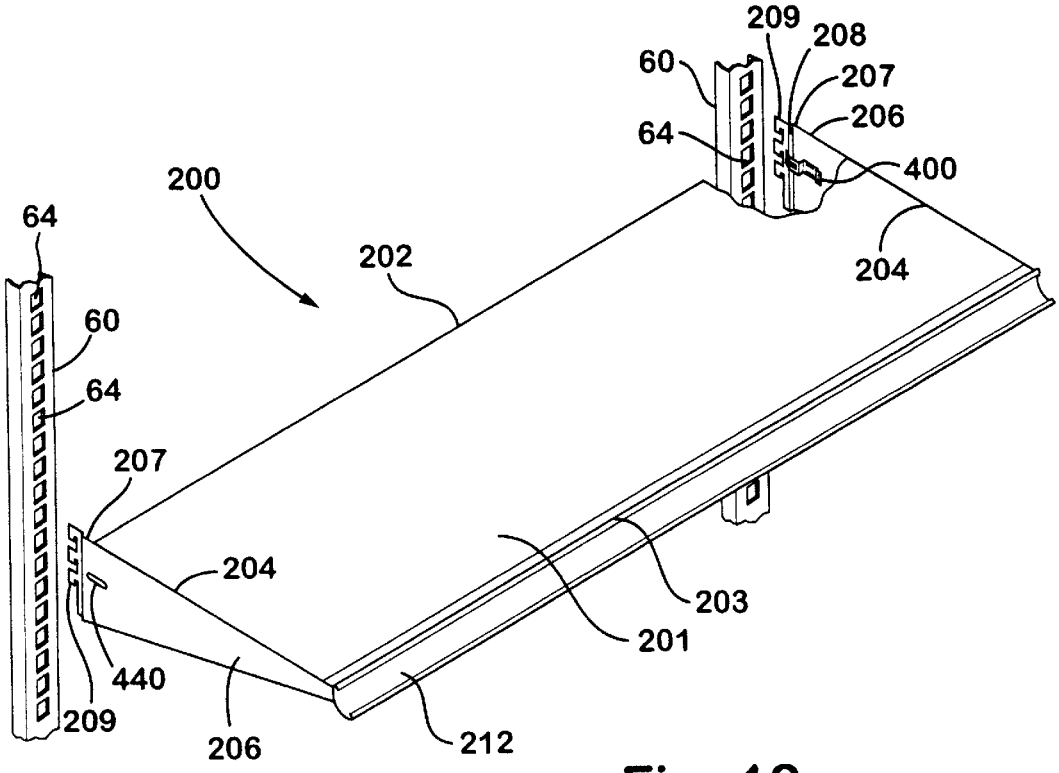
FIG. 18 is fragmentary, perspective view of a flat shelf for use with the dispensing rack.

With reference to FIG. 18, flat shelf 200 comprises a rigid, planar panel 201 having opposing sides 204. Each side 204 has depending therefrom a side support flange 206. Support flanges 206 may be joined to sides 204 by any method commonly employed in the industry. For example, support flanges 206 may be spot welded to sides 204. Each support flange 206 has a tapered configuration and extends beyond rear 202 of panel 201. Each support flange 206 increases in height from front 203 to rear 202 of panel 201. End 207 of flange 206 has an orthogonally extending member 208 having at its end a plurality of fingers 209 projecting therefrom. Each finger 209 is substantially parallel to side support flange 206 and has a generally L-shaped configuration. Each finger 209 is dimensioned to be received by an aperture 64 of upright support 60. As illustrated, each flange 206 contains three fingers 209. Consequently, when positioned within upright support 60, these three fingers 209 will be received by three adjacent apertures 64. Although depicted as having three fingers 209, it will be recognized by those with ordinary skill in the art that each flange 206 may have a greater or lesser number of fingers 209, without departing from the spirit and scope of the invention. Attached to front 203 of panel 201 is a horizontally disposed curved member 212. Again, for example, curved member 212 may be attached to front 203 of panel 201 by spot welding. Each flange 206 is equipped with a horizontal slot 440 dimensioned to slidably receive a locking clip 400, the details of which are described below.

Figure 19:
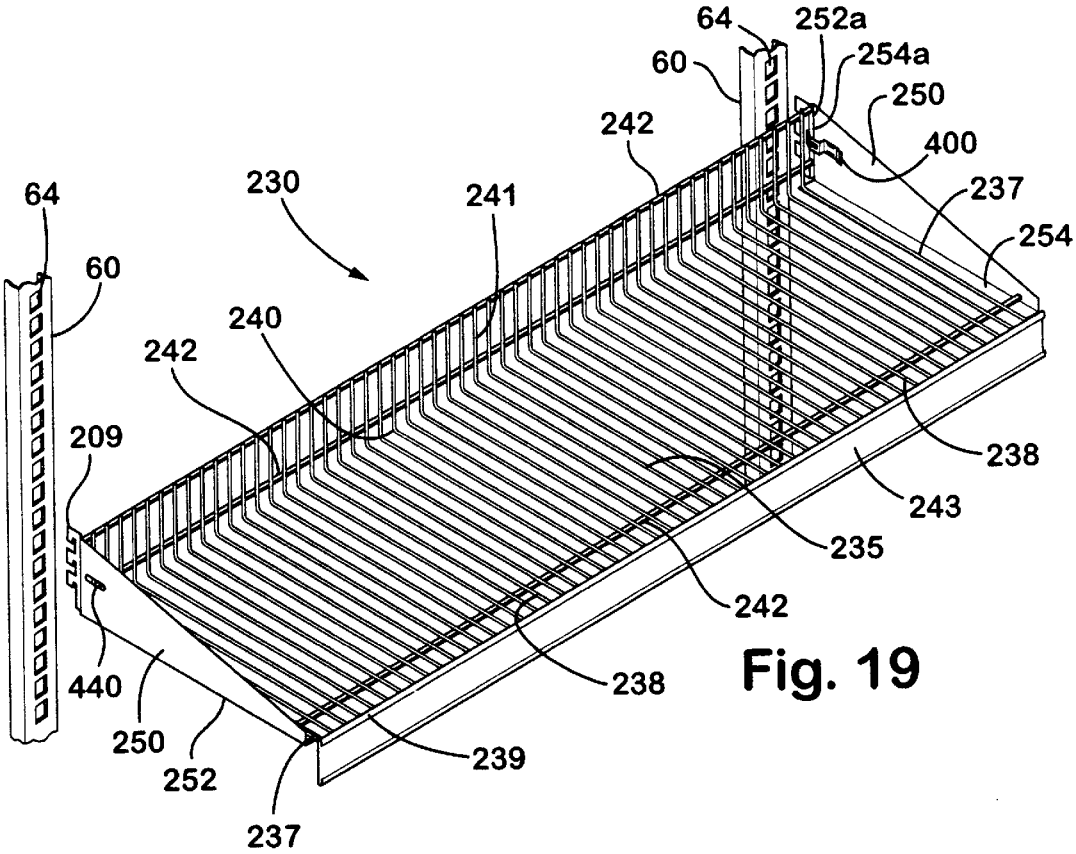
FIG. 19 is a perspective view of a promotional shelf for use with the dispensing rack.

Turning now to FIG. 19, promotional shelf 230 includes a central section 235 joined at its opposing sides 237 to a pair of side support flanges 250. Central section 235 is preferably of a "wire" configuration having a plurality of generally horizontal bars 238. Bars 238 curve upward at rear 240 to form a vertical section 241. A plurality of transverse support bars 242 are attached to bars 238, providing additional strength to central section 235.

Each support flange 250 extends upwardly from a side 237 of central section 235 and has a tapered configuration, with the height of each flange 250 increasing from front 239 to back 240 of central section 235. A ledge 254 extends horizontally from bottom 252 of each support flange 250, providing a surface upon which central section 235 is secured by any means commonly utilized in the industry. End **254*a* of each support flange 250 has an orthogonally extending member 252*a* having at its end a plurality of fingers 209, enabling promotional shelf 230 to be removably secured to upright supports 60. Each support flange 250 is equipped with a horizontal slot 440 dimensioned to slidably receive a locking clip 400. Attached to front 239 of central section 235 is a horizontally disposed member 243**.

Figure 20:
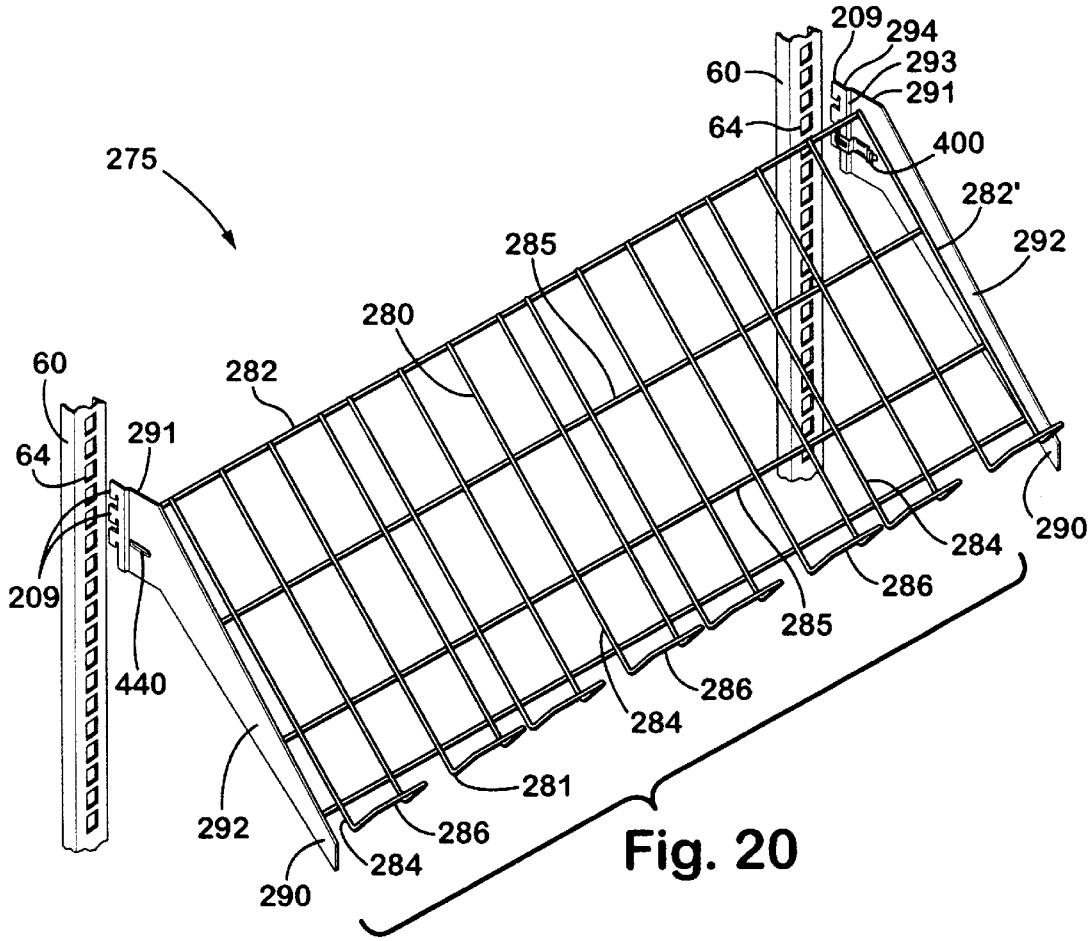
FIG. 20 is a perspective view of a cascading shelf for use with the dispensing rack.

Referring now to FIG. 20, cascading shelf 275 comprises a central section 280, attached at its opposing sides 282' to side support flanges 290. Central section 280 has a "wire" configuration with a plurality of bars 284 placed in spaced relation and attached to a plurality of cross bars 285. At front 281 of central section 280, bars 284 are curved upwardly, with each adjacent pair of bars 284 joined together by a bridge member 286.

Each support flange 290 includes a rear portion 291 joined to a downwardly angled front portion 292. Attached to end 293 of rear portion 291 of each support flange 290 is a orthogonally extending member 294 having at its end a plurality of fingers 209, permitting cascading shelf 275 to be removably inserted within, and supported by, upright supports 60. Each support flange 290 has formed along rear section 291 a horizontal slot 440 dimensioned to receive a locking clip 400.

Central section 280 is joined to support flanges 290 by, for example, spot welding. When attached to support flanges 290, central section 280 will be obliquely positioned such that the horizontal plane defined by rear 282 of central section 280 will be positioned above the horizontal plane defined by front 281. The downwardly angled central section 280 permits product to be supported at an oblique angle, while the upward curvature of bars 284 at front 281 prevents product from falling from cascading shelf 275 by the effect of gravity.

With reference to FIGS. 21 through 29, spring loaded shelf 300 comprises a frame 310, a pair of side support flanges 320, and at least one spring loaded tray 360. Frame 310 includes a rear 311, a front 312, and opposing sides 315. Extending inwardly from opposing sides 315 of frame 310 is a horizontal side ledge 316. Extending inwardly from front 312 is a horizontal front ledge 317. Each side ledge 316 is formed having a vertical member 319 depending therefrom. Attached to vertical member 319 is a horizontal member 321 which is approximately parallel to side ledge 316 and extends outwardly toward a side 315 of frame 310. Attached to end 321' of horizontal member 321 is an upwardly extending tab 322. Preferably, tab 322 is approximately co-planar with outer surface 315' of side 315. Each side ledge 316, vertical member 319, horizontal member 321 and tab 322 define a track 319'.

Figure 21:
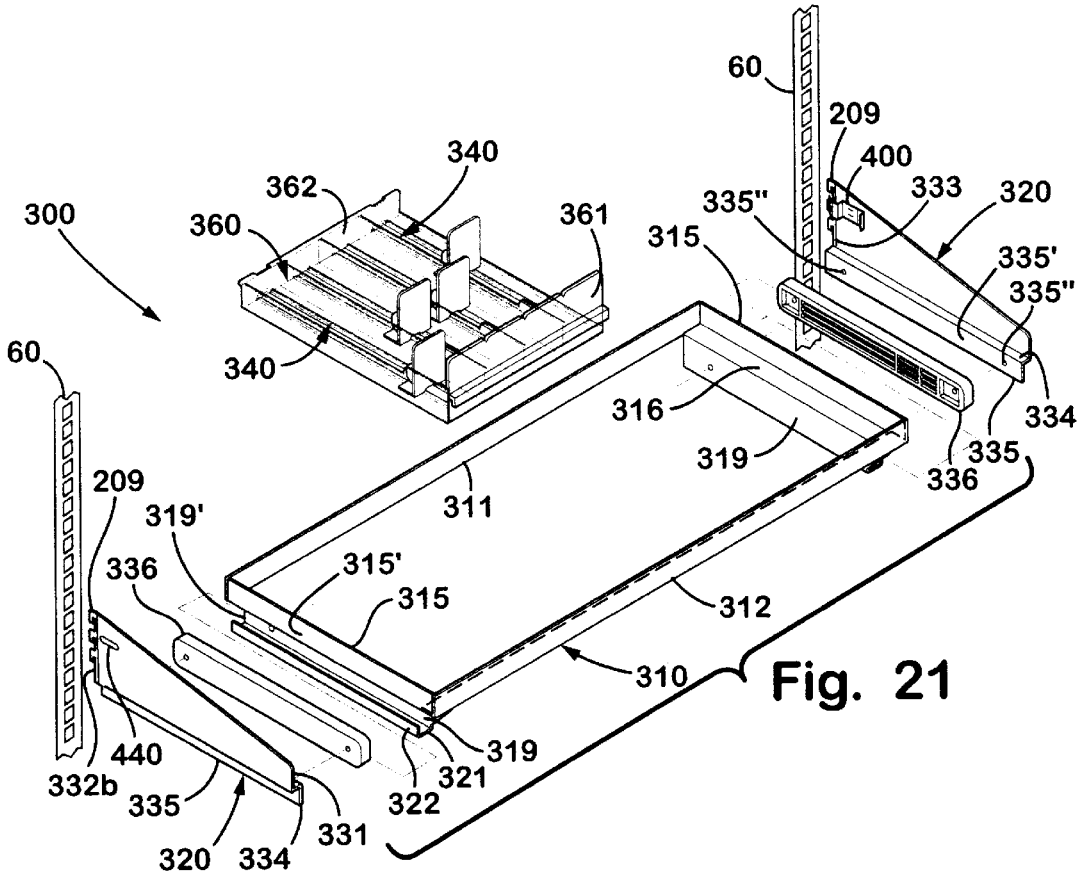
FIG. 21 is an exploded view of a spring loaded shelf for use with the dispensing rack.
Figure 22:
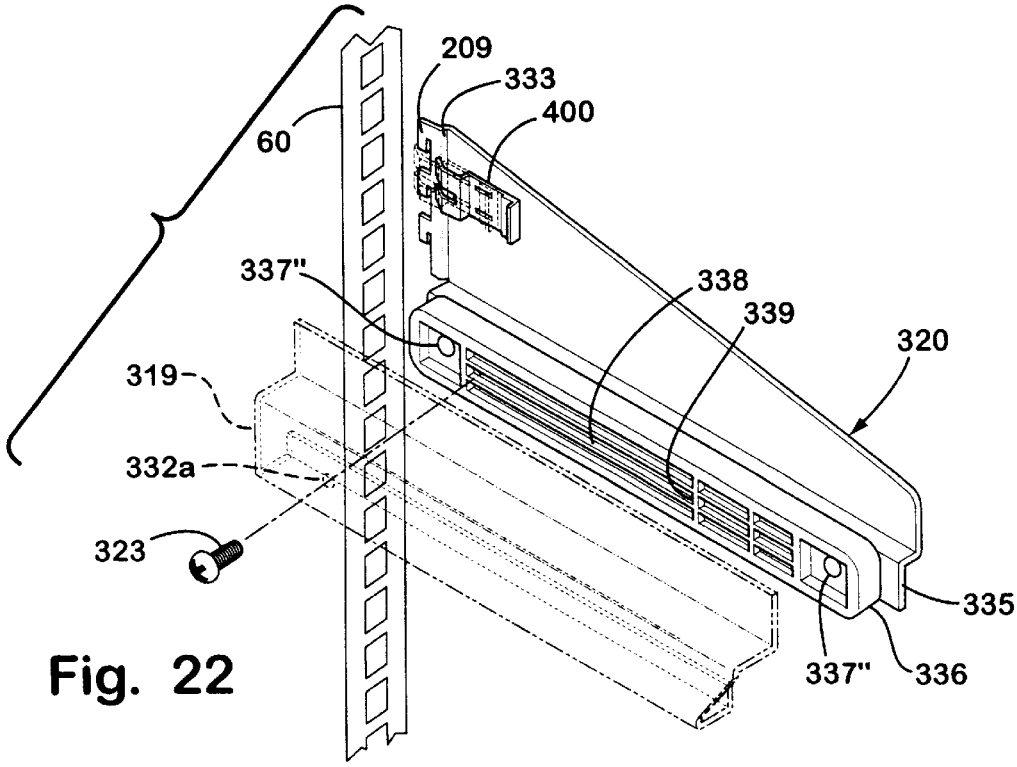
FIG. 22 is a perspective, partially ghosted view depicting the connection of the shelf frame and the side support flange of the spring loaded shelf.
Figure 24:
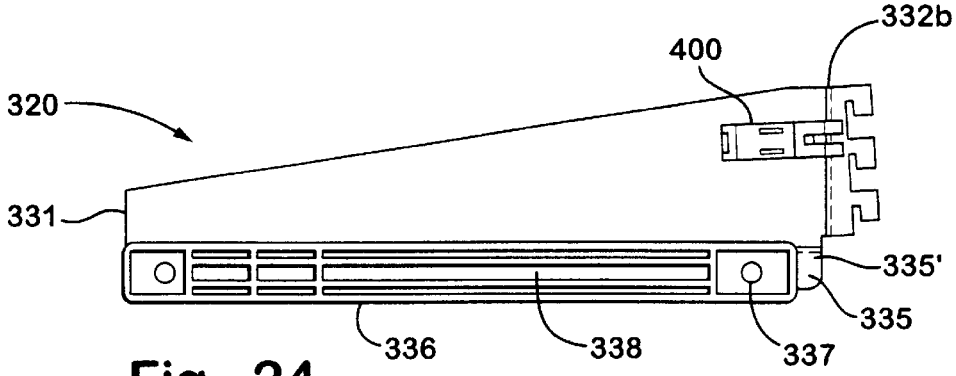
FIG. 24 is a side view of the side support flange and slide bar of the spring loaded shelf.
Figure 25:
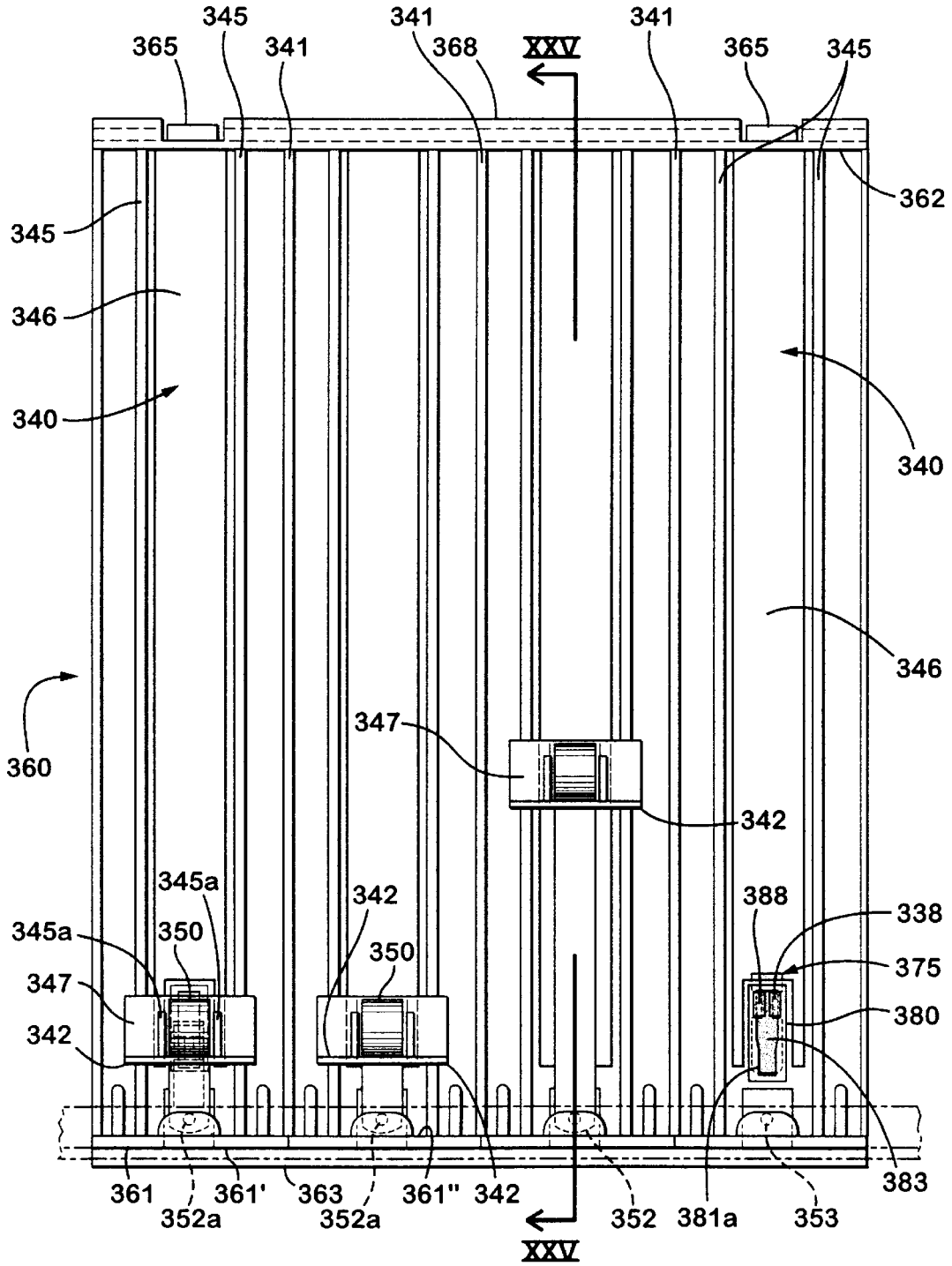
FIG. 25 is a top view of the spring loaded tray of the spring loaded shelf.

Seen most clearly in FIGS. 21 and 24, each support flange 320 extends upwardly and has a tapered configuration, with the height of each flange 320 increasing from front 331 to rear 332*b*. A ledge 334 extends horizontally from bottom 332 and is attached at its end to a vertically oriented member 335. An orthogonally extending member 333 is attached to rear 332*b* of each flange 320 and has extending therefrom a plurality of fingers 209, enabling spring loaded shelf 300 to be removably attached to upright supports 60. Each support flange 320 has formed therein a horizontal slot 440 dimensioned to receive a locking clip 400. As shown in FIG. 24 fingers 209 are positioned at a slightly upwards angle.

A slide bar 336 is attached to inner surface 335' of vertical member 335 of each support flange 320. Securement between slide bar 336 and inner surface 335' of vertical member 335 is achieved by inserting nut and bolt assemblies 337', or like fasteners, through apertures 335" formed in vertical members 335 and apertures 337" formed in slide bar 336. Each track 319' is dimensioned to receive a slide bar 336, thereby enabling frame 310 to slide horizontally along slide bars 336. Each vertical member 319 of frame 310 is formed with a throughhole 322*a* dimensioned to receive a screw 323. Screw 323 projects within a horizontal channel 338 formed in inner surface 337 of slide bar 336. The length of horizontal channel 338 is less than the length of slide bar 336. Consequently, when frame 310 is pulled in an outward direction from interior 3 of dispensing rack 1, screw 323 will abuttingly contact end 339 of horizontal channel 338, and hence provide a stop preventing the disengagement of frame 310 from support flanges 320. The sliding engagement between frame 310 and support flanges 320 enables an operator to extract frame 310 from interior 3 of dispensing rack 1 when support flanges 320 are secured to upright supports 60. Consequently, an operator can load spring loaded shelf 300 with additional product without having to disengage the same from upright supports 60.

Spring loaded tray 360 is of a generally rectangular construction and removably positioned within frame 310, and is supported at its sides by side ledges 316. Spring loaded tray 360 has front panel 361 and an opposing rear panel 362. Extending from outer surface 361' of front panel 360 is a downwardly curved flange 363. Projecting from rear surface 362' of rear panel 362 is a downwardly curved top flange 368 and a bottom flange 365. To removably insert spring loaded tray 360 within frame 310, top flange 368 is placed over rear 311 of frame 310. Thereafter, spring loaded tray 360 is laid within frame 310 such that bottom flange 365 is positioned under rear 311 of frame 310, while flange 363 is positioned over front 312 of frame 310.

Each spring loaded tray 360 has a plurality of track assemblies 340, separated by vertically upright walls 341. Each track assembly 340 includes a vertical partition 342. Vertical partition 342, walls 341 and front panel 361 serve to confine product within a particular track assembly 340.

Figure 27:
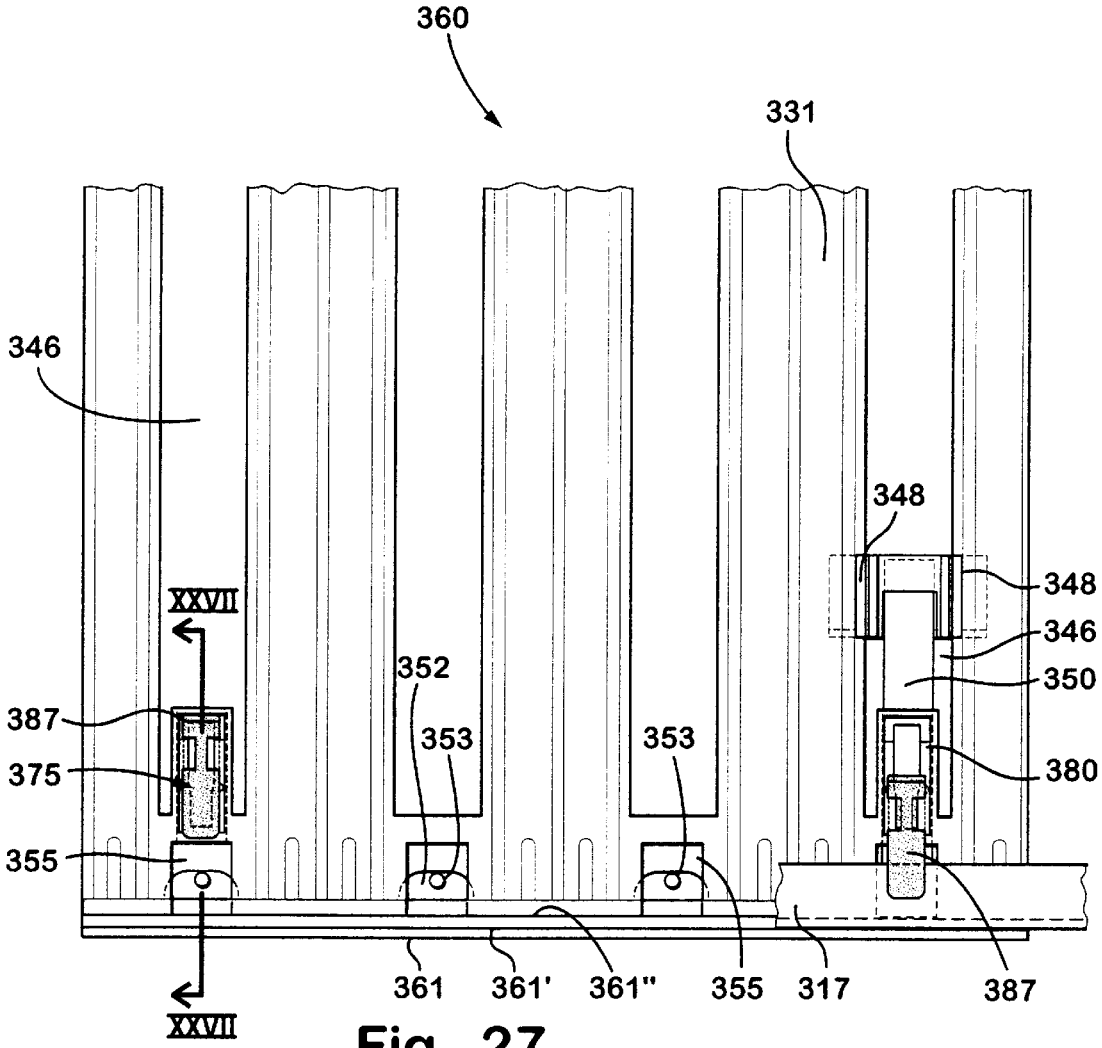
FIG. 27 is a fragmentary bottom view of the spring loaded tray of the spring loaded shelf.

Each track assembly 340 further includes a pair of upright track members 345, separated by a laterally positioned slot 346. A horizontal base 347, attached to vertical partition 342, includes a pair of L-shaped guides 348 depending from undersurface 347'. L-shaped guides 348 depend through slot 346 and sliding contact undersurface of 331 of spring loaded tray 360 (FIG. 27). Extending from rear surface 342' of vertical partition 342 is a pair of confining plates 345*a* placed a preselected distance apart. A rolled or coiled extender 350 is positioned between plates 345*a*. Coiled extender 350 is preferably a piece of sheet metal and positioned so that its central axis runs horizontally. Coiled extender 350 is thread through a cutout section 346' formed at the intersection of vertical partition 342 and horizontal base 347. Coiled extender 350 biases vertical partition 342 toward front panel 361.

Formed along inner surface 361" of front panel 361 of spring loaded tray 360 is a horizontally positioned arcuate member 352 having a pin 353. Pin 353 depends into a rectangular cut-out 355 formed in track assembly 340 and positioned between front panel 361 and slot 346. Front section 351 of coiled extender 350 is formed with an aperture 352*a*. Front section 351 of coiled extender 350 is inserted within rectangular cut-out 355 with pin 353 being received by aperture 352*a*.

In operation, product is inserted between front panel 361 of spring loaded tray 360 and vertical partition 342. Insertion of product in this manner slidingly urges vertical partition 342 along track members 345 in a rearward direction toward rear panel 362. Removal of product from spring loaded tray 360 causes movement of vertical partition 342 in a forward direction due to the internal tension of coiled extender 350.

At least one securing assembly 375 is provided to thereby secure spring loaded tray 360 within frame 310. As shown in FIG. 27, the two distal track assemblies 340 are shown having securing assemblies 375. Securing assembly 375 includes a guide track 380, proximate to front panel 361 and extending toward rear panel 362 within slot 346. A securing clip 387 is attached to underside 381 of guide track 380 by a pair of upturned flanges 388 which extend through slot 383 formed in guide track 380 and are in abutting contact with the upper surface of guide track 380. Guide track 380 is formed having a section of narrowed width 381*a* and a pair of ramps 381'. Securing clip 387 includes a tab 390 and a front section 391.

Figure 29:
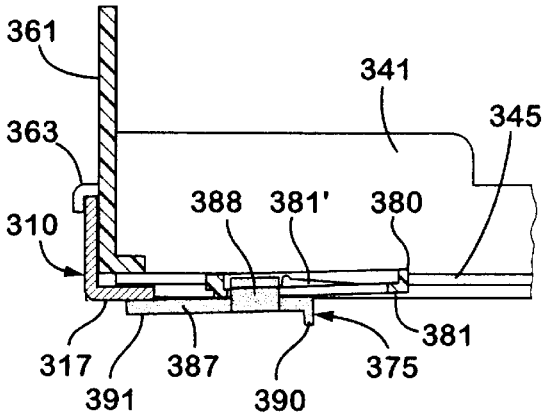
FIG. 29 is the same view as FIG. 28 with the securing assembly depicted in the secured position.
Figure 28:
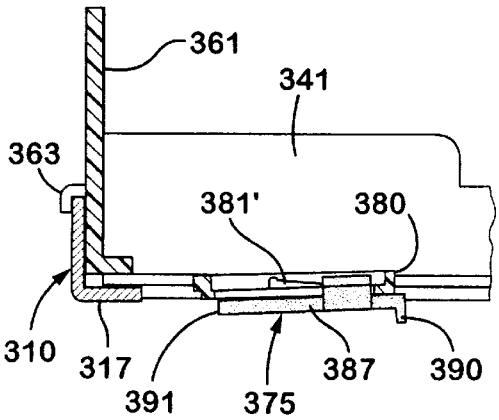
FIG. 28 is a detailed, cross section side view of the spring loaded tray, depicting the securing assembly in the unsecured position, taken along lines XXVII—XXVII of FIG. 27.

To secure spring loaded tray 360 within frame 310, spring loaded tray 360 is first inserted within frame 310 in the manner described above. Thereafter, a slight force is applied to tab 390 of securing clip 387 to move securing clip 387 from the unsecured position as depicted in FIG. 28 to the secured position as shown in FIG. 29, where securing clip 387 clears ramps 381' and resides within narrowed width section 381*a*. In the secured position, the outer surfaces of flanges 388 frictionally engage the walls of narrowed width section 381*a* of guide track 380, while front section 391 of securing clip 387 is placed in abutting contact with the undersurface of front ledge 317. Preferably, guide track 380 is formed at a slightly inclined angle such that securing clip 387 will travel in a slightly downward direction as it is moved from the unsecured to the secured position. This slightly downward movement of securing clip 387 assures abutting contact between securing clip 387 and the undersurface of front ledge 317 of frame 310.

Referring now to FIGS. 30 through 36, there is shown a locking clip 400 which, when in the engaged position, prohibits the removal of a particular shelf 4 from interior 3 of dispensing rack 1 by preventing the extraction of the side support flanges 206, 250, 290, or 320 from upright supports 60. Each shelf configuration, namely flat shelf 200, promotional shelf 230, cascading shelf 275 and spring loaded shelf 300 is equipped with a pair of locking clips 400. The structure and function of locking clip 400 is the same, regardless of the type of shelf 4 being secured, and therefore, locking clip 400 will be explained with reference to spring loaded shelf 300.

Locking clip 400 includes a planar member 410 positioned flush against inner surface 320' of support flange 320. Rear 412 of planar member 410 includes a tab 413 extending therefrom. An orthogonal member 414 is formed at the front of planar member 410 and has at its end a pair of arms 416 and 418 extending perpendicularly therefrom. Arms 416, 418 include curved ends 417 and 419. Curved ends 417 and 419 of arms 416 and 418 are curved inward toward inner surface 320' of support flange 320. Arms 416, 418 are positioned in spaced relation such that the distance between edge 416' of arm 416 and edge 418' of arm 418 is slightly less than the height of an aperture 64 of upright support 60. Depending from undersurface 411 of planar member 410 is a pair of guides 420. Guides 420 extend through slot 440 and are curved to slidingly engage outer surface 320" of support flange 320. Undersurface 411 is also formed with an arcuate stop member 422 dimensioned for receipt by slot 440. Locking clip 400 is preferably made of a slightly bendable polymeric material.

Figure 33:
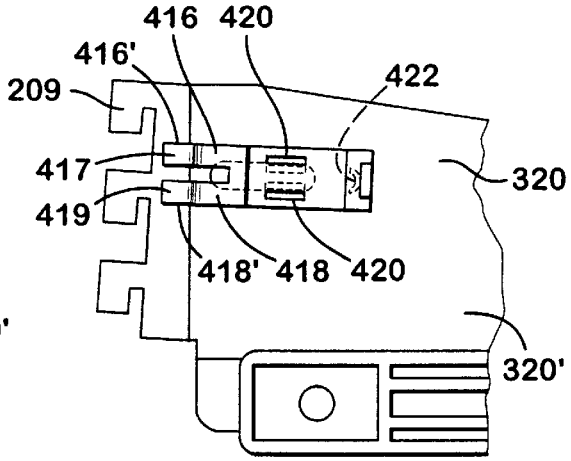
FIG. 33 is a detailed, fragmentary side view of a locking clip carried by a side support flange, with the locking clip shown in the unsecured position.
Figure 34:
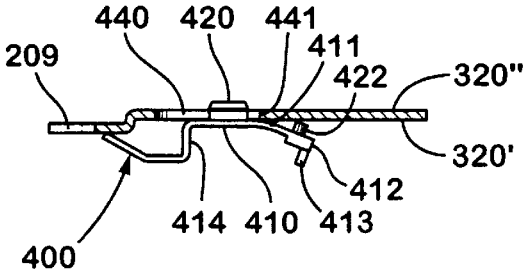
FIG. 34 is a detailed, fragmentary top view of a locking clip carried by a side support flange, with the locking clip shown in the unsecured position.
Figure 37:
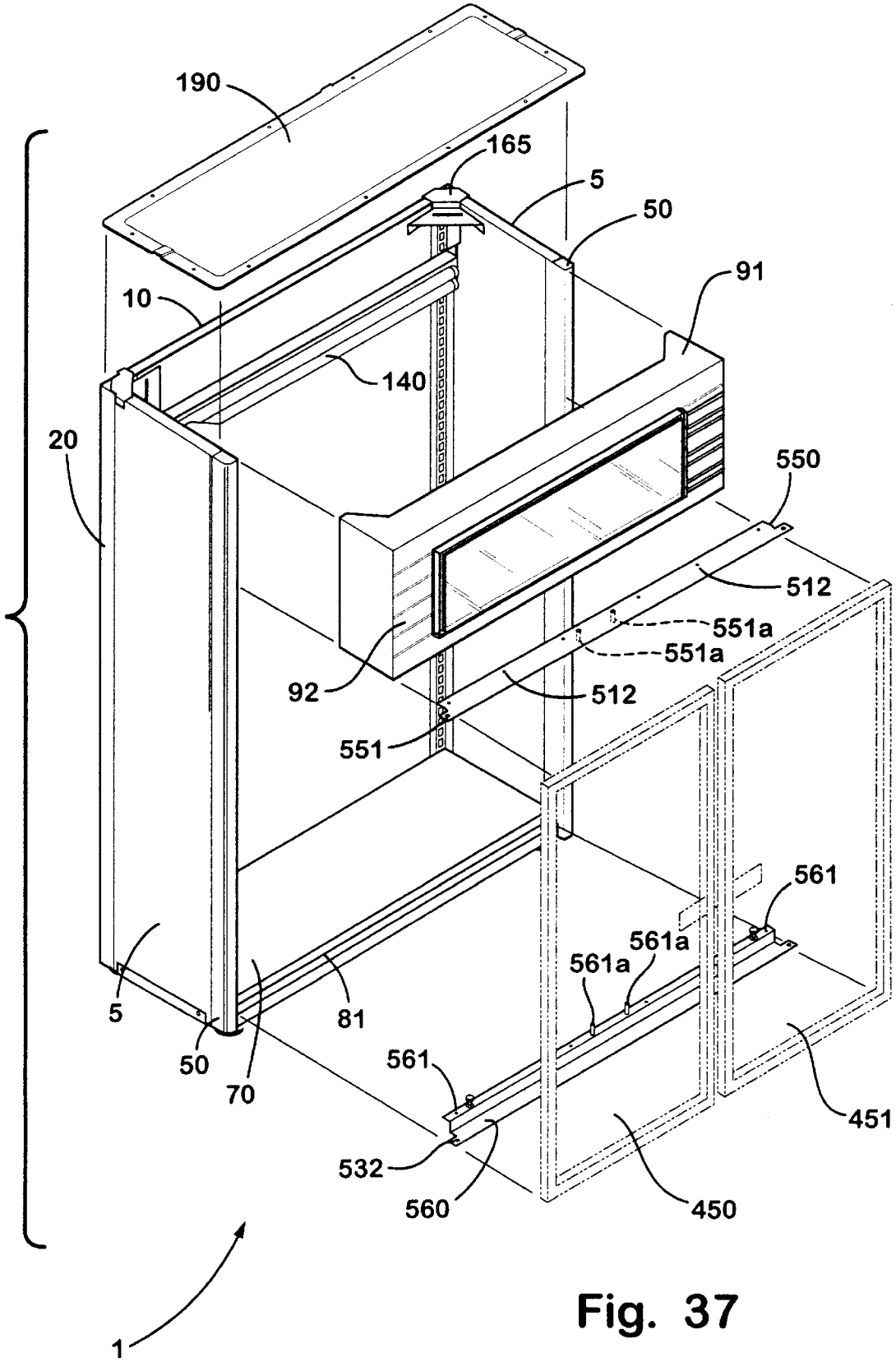
FIG. 37 is an exploded perspective view of a dispensing rack fitted with a pair of doors.
Figure 38:
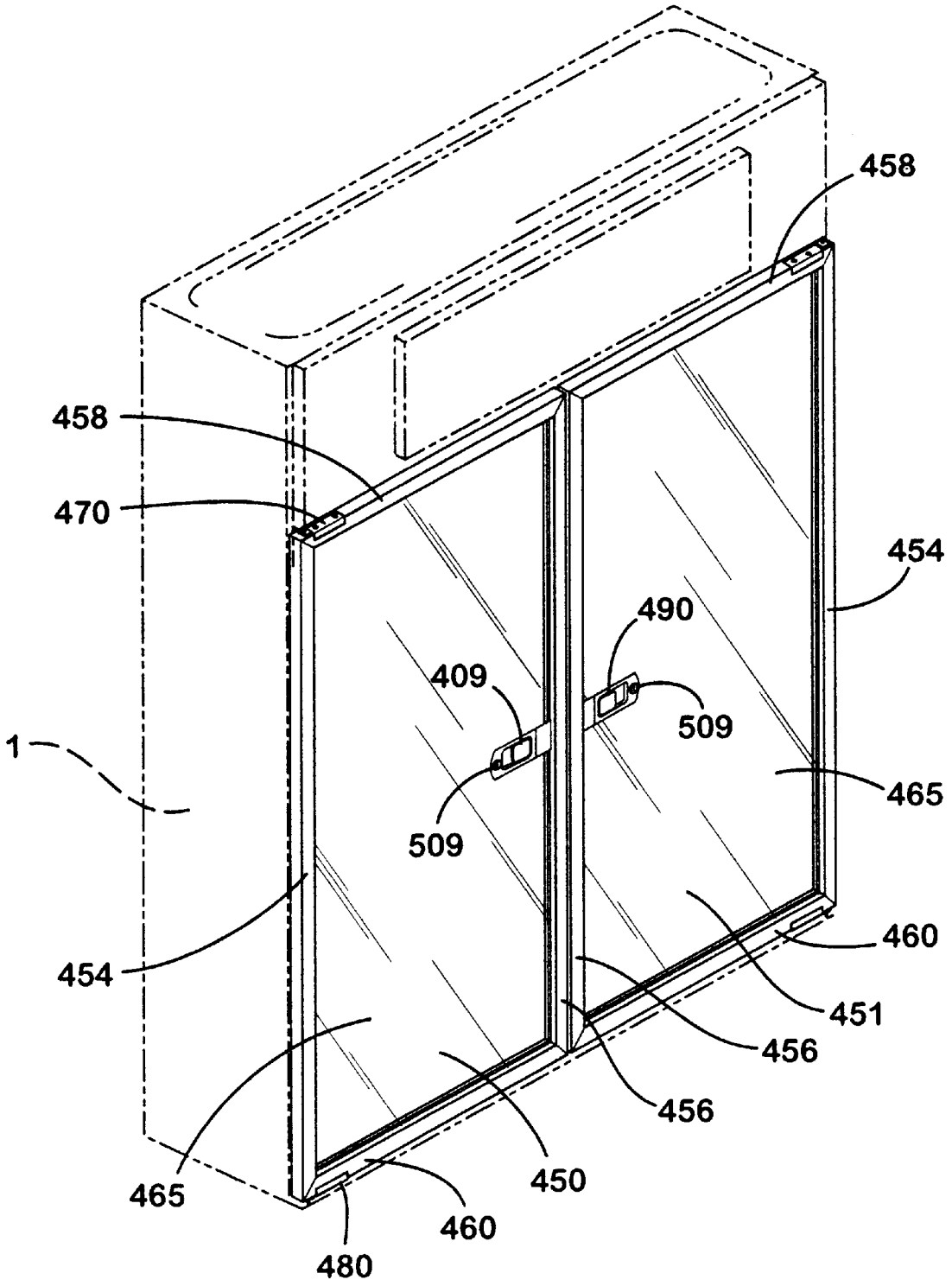
FIG. 38 is a partially ghosted, perspective view of the dispensing rack of FIG. 37.

To operate locking clip 400, a slight force is applied to tab 413 to lift arcuate stop member 422 from horizontal slot 440. Thereafter, using tab 413, locking clip 400 is slidingly moved along horizontal slot 440 until guides 420 are positioned proximate to end 441 of slot 440. At this point, locking clip 440 is in the disengaged position as depicted by FIGS. 33 and 34.

Figure 30:
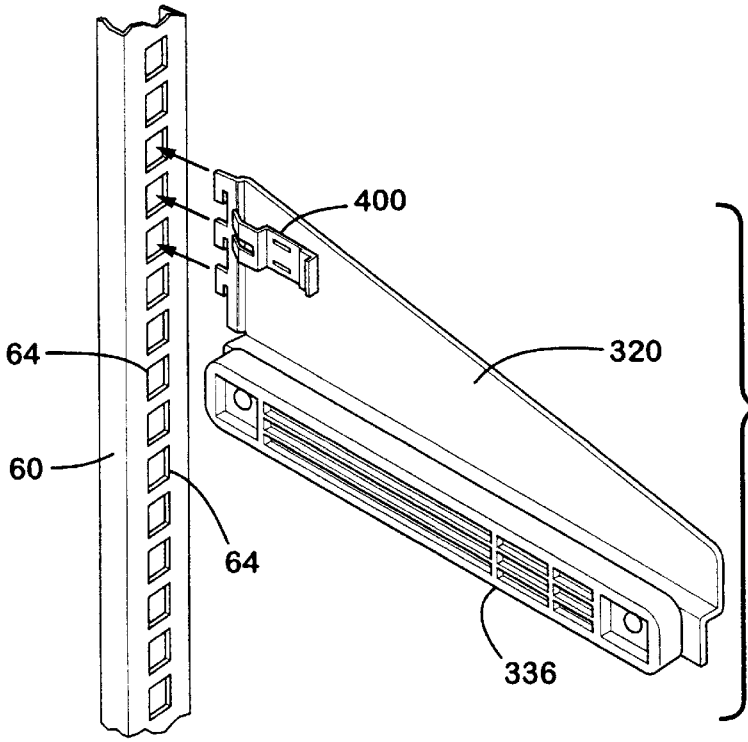
FIG. 30 is a perspective view depicting a locking clip carried by a side support flange with the side support flange shown unsecured to the upright support.
Figure 31:
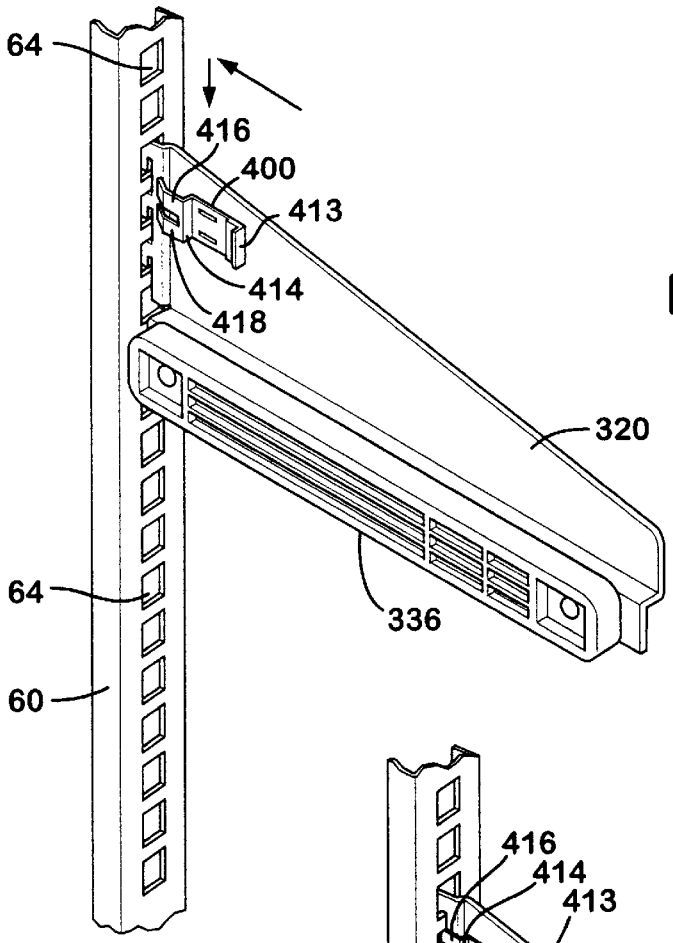
FIG. 31 is a perspective view depicting a locking clip carried by a side support flange, with the side support flange shown partially secured to the upright support.
Figure 32:
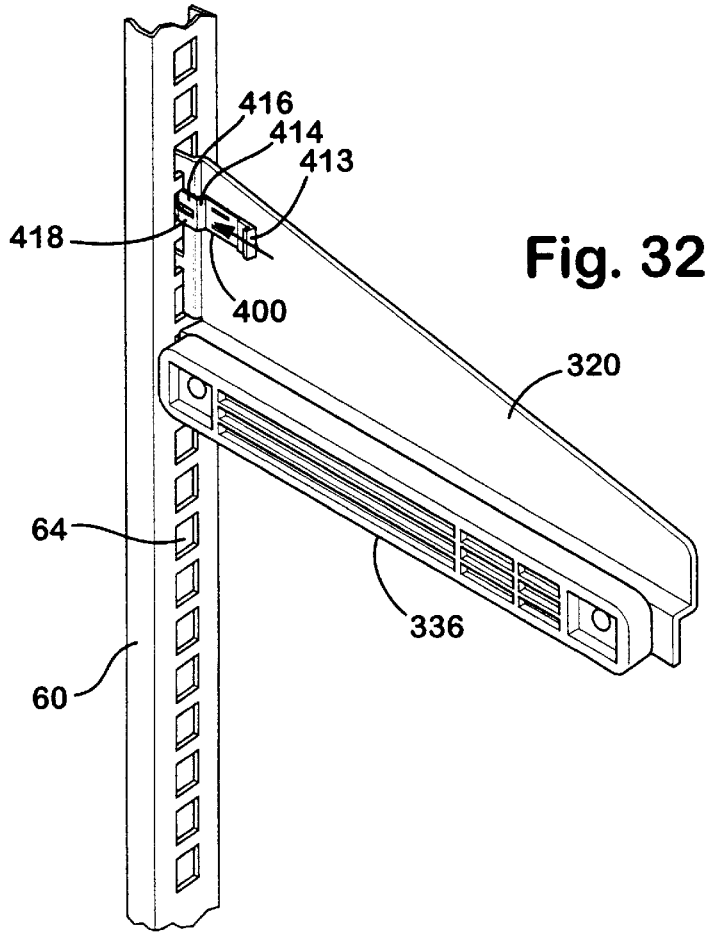
FIG. 32 is a perspective view depicting a locking clip carried by a side support flange, with the side support flange shown secured to the upright support, with the locking clip in the secured position.
Figure 35:
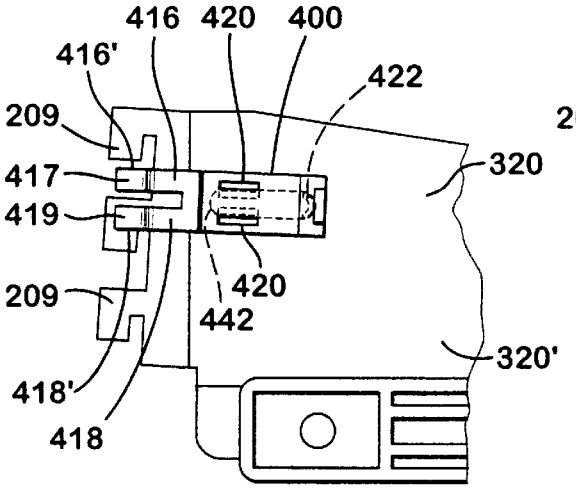
FIG. 35 is the same view as FIG. 33, with the locking clip shown in the secured position.
Figure 36:
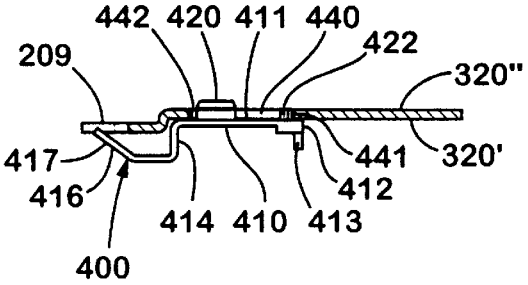
FIG. 36 is the same view as FIG. 34, with the locking clip shown in the secured position.

Spring loaded shelf 300 is then inserted within upright supports 60 by inserting L-shaped fingers 209 of side support flange 320 within apertures 64 (FIGS. 30 through 32). Once L-shaped fingers 209 are positioned within apertures 64, a slight force is applied to tab 413 to urge locking clip 400 into a locked position such that guides 420 are positioned proximate to end 442 of slot 440 (FIGS. 35 and 36). When in such position, arms 416, 418 of locking clip 400 extend within an aperture 64 occupied by a L-shaped finger 209. Once locking clip 400 is in the locked position, an attempt to remove spring loaded shelf 300 from upright supports 60 will be prohibited. Specifically, the placement of arms 416 and 418 within an aperture 64 will prohibit the upward rotational movement of support flange 320 necessary to remove the same from upright supports 60.

It is important to recognize that when in the locked position, arcuate stop member 422 is positioned within and flush against end 441 of slot 440. Consequently, once in the locked position, locking clip 400 can not be disengaged by pulling tab 413 in a rearward direction. To disengage locking clip 400 from upright support 60, a slight force must be applied to tab 413 to lift arcuate stop member 422 from slot 440. Thereafter, locking clip 400 may be moved in a rearward direction to thereby remove arms 416, 418 from an aperture 64. As illustrated, locking clip 400 is positioned within the aperture 64 occupied by the middle L-shaped finger 209. However, it will be recognized by those with ordinary skill in the art that locking clip 400 may be positioned within the aperture 64 occupied by the lowermost L-shaped finger 209 by repositioning slot 440, and that such alternative is within the spirit and scope of the invention.

Referring now to FIGS. 37 through 44, there is shown a dispensing rack 1 equipped with a pair of doors 450 and 451. Doors 450, 451 are attached to dispensing rack 1 and open outwardly away from interior 3 of dispensing rack 1. Each door 450, 451 is similar in both function and structure and therefore, the following discussion will make reference to door 450 only.

Door 450 has a frame 452 composed of sides 454 and 456, top 458 and bottom 460. Positioned within frame 452 is a transparent sheet of material 465. Transparent sheet of material 465 may be, for example, glass or a polymeric composition.

Figure 13:
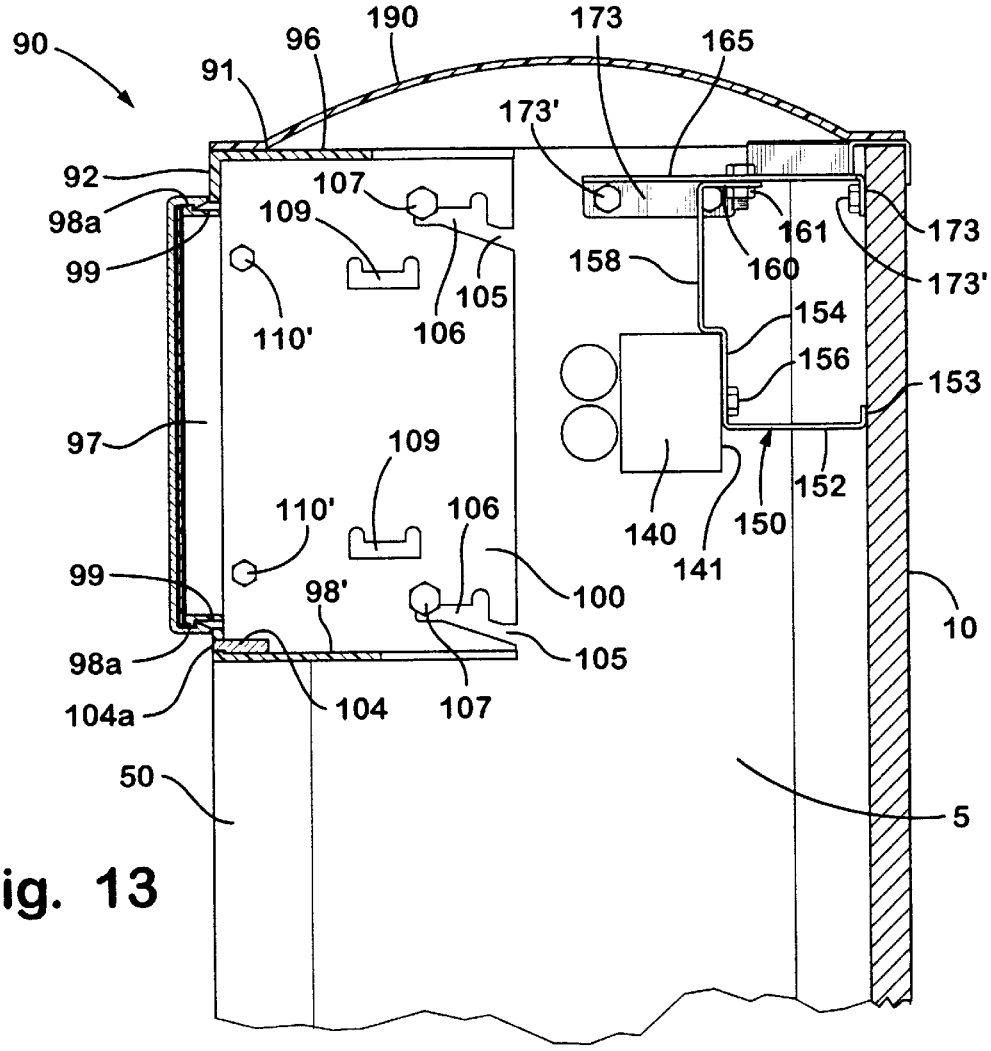
FIG. 13 is a cross sectional side view of the header assembly and light strip positioned within the interior of the dispensing rack.
Figure 14:
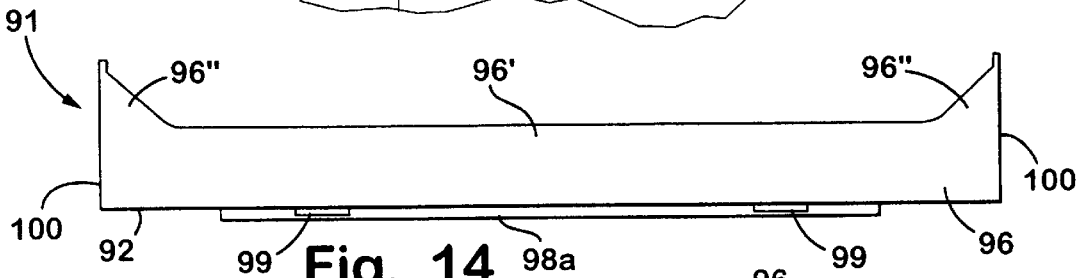
FIG. 14 is a top view of the header member of the dispensing rack.
Figure 15:
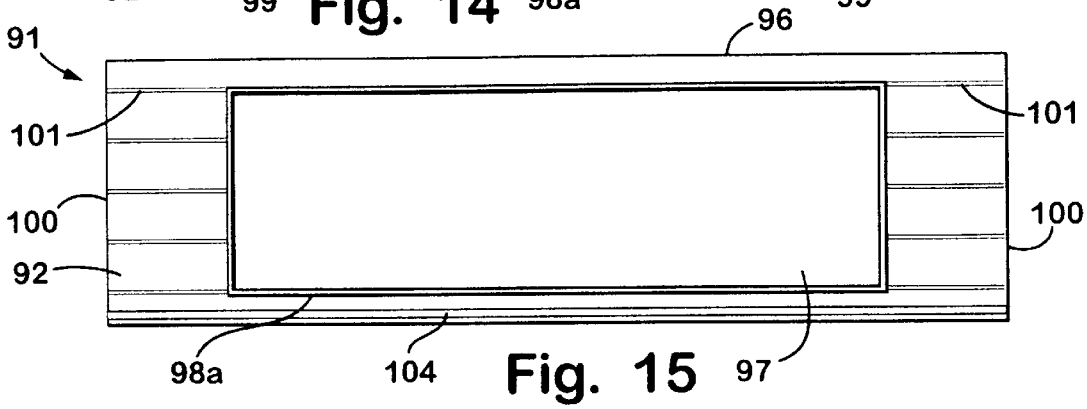
FIG. 15 is a front view of the header member of the dispensing rack.
Figure 16:
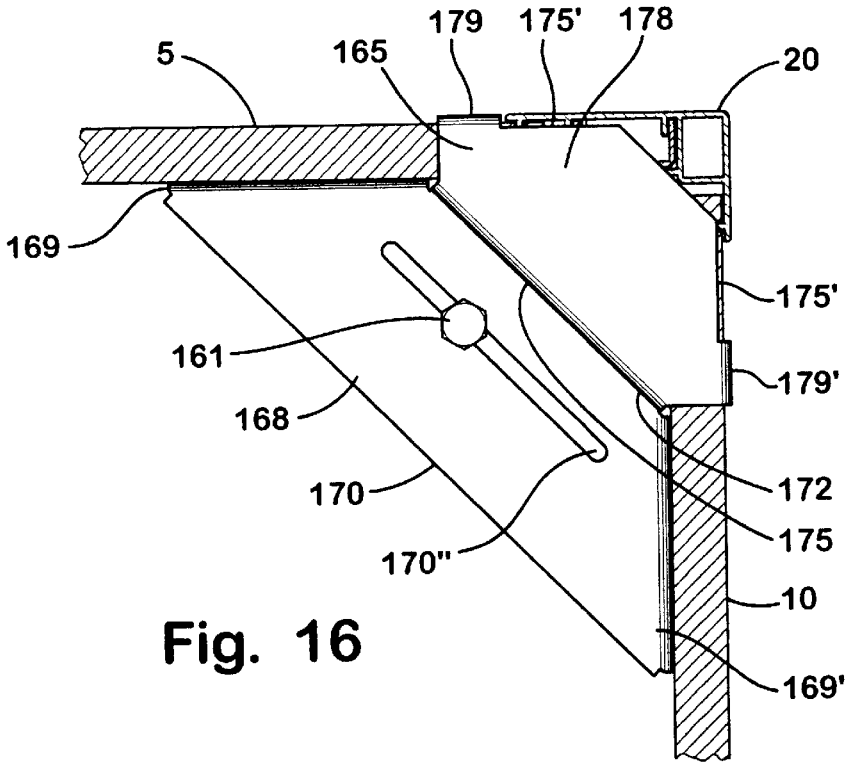
FIG. 16 is a top view of a corner gusset attached to a side panel and the back panel of the dispensing rack.

To attach door 450 to dispensing rack 1, header member 91 is first attached to dispensing rack 1 such that front 92 of header member 91 extends beyond the open face of is dispensing rack 1. This is achieved by placing bolts 107 in the rearward most annular sections 106' and 109' of sides 100 (FIG. 13). Once header member 91 is attached to dispensing rack 1, a top ledge 550 is attached to the underside of header member 91, by bolts or like-fasteners (not shown), which are positioned through apertures 512 and driven into header member 91. Thereafter, a bottom ledge 560 is fastened to horizontal ledge 81 of bottom assembly 70 by driving screws 562 through holes 561 of bottom ledge 560. When attached, bottom ledge 560 will extend beyond the face of dispensing rack 1.

Figure 39:
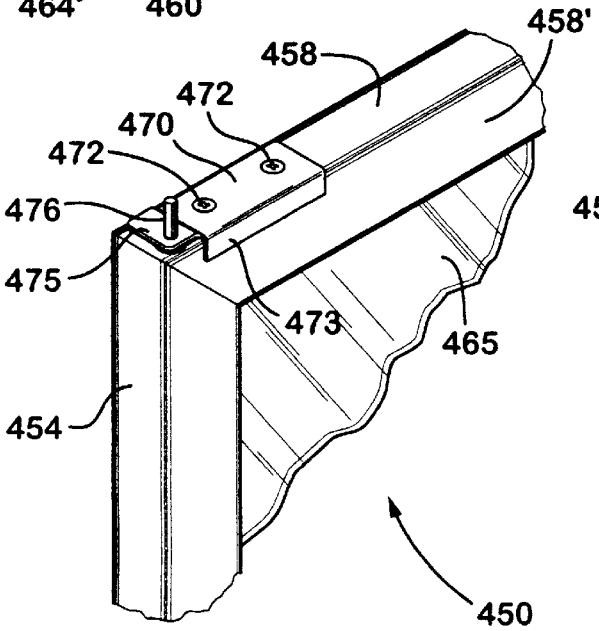
FIG. 39 is a fragmentary, top view of top hinge plate attached to the top of the door frame.
Figure 40:
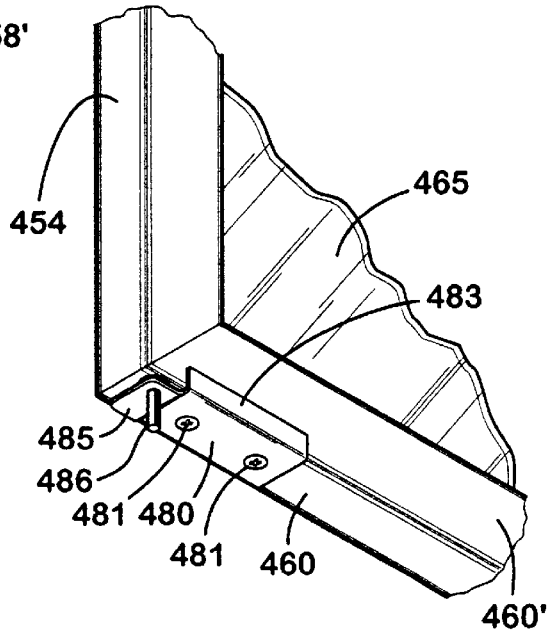
FIG. 40 is a fragmentary, bottom view of a bottom hinge plate attached to the bottom of the door frame.
Figure 41:
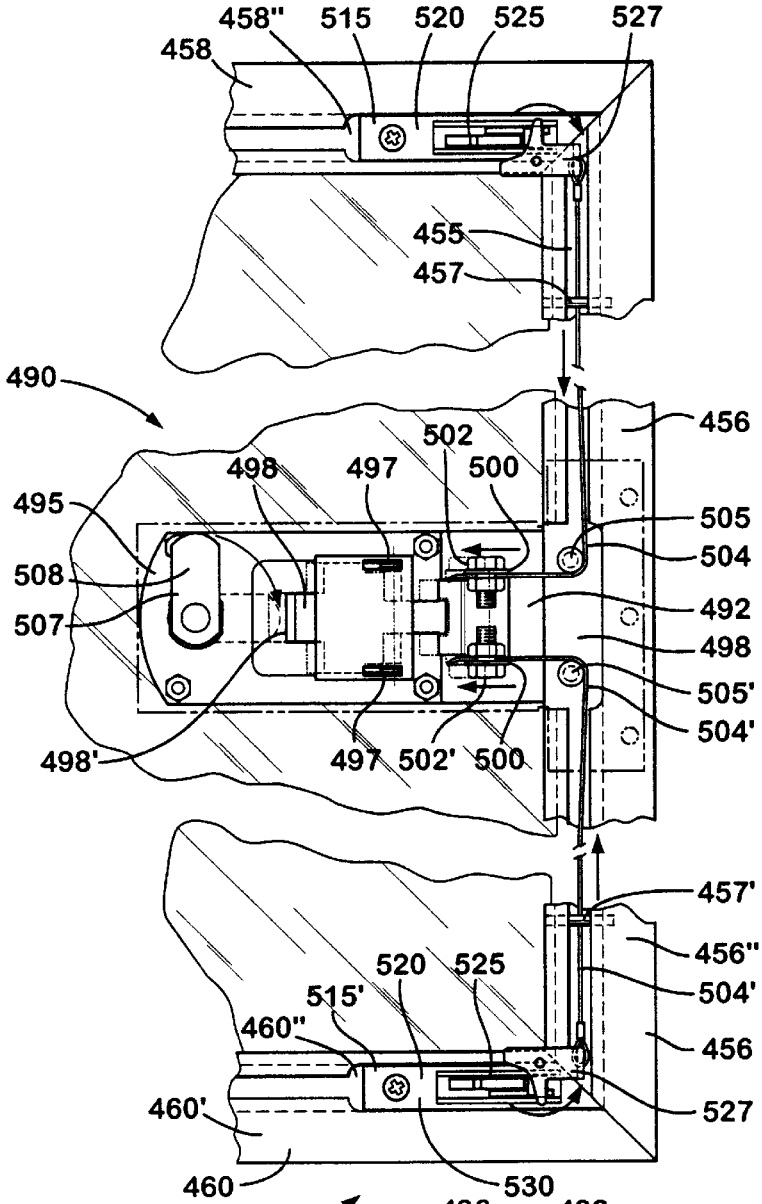
FIG. 41 is a fragmentary, detailed rear view of the door, illustrating the door locking assembly.
Figure 43:
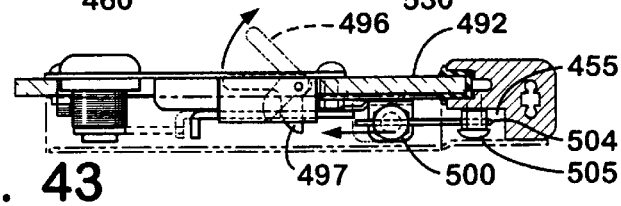
FIG. 43 is a horizontal cross sectional view of the door lock of FIGS. 41 and 42.
Figure 44:
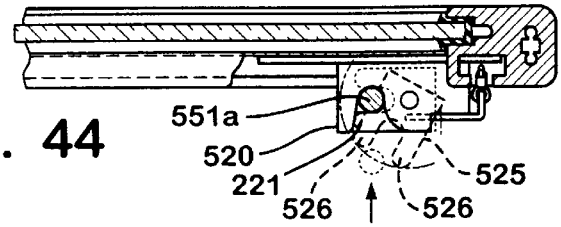
FIG. 44 is a horizontal cross sectional, fragmentary view of a latch assembly of the door locking assembly of FIG. 41.
Figure 42:
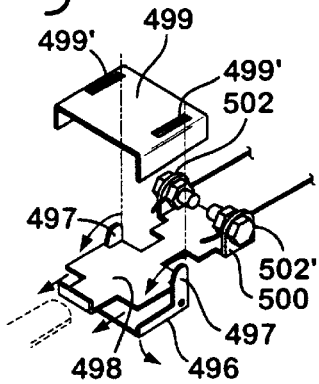
FIG. 42 is a exploded, perspective view of the door lock of FIG. 41.

A top pivot plate 470 is attached to top 458 of frame 452 and positioned proximate to side 454 (FIG. 39). Top pivot plate 470 is attached to top 458 by screws 472 and contains an orthogonally projecting member 473 which extends over front surface 458' of top 458. Top pivot plate 470 also includes a raised section 475 having a pin 476 extending therefrom. In a similar fashion, a bottom pivot plate 480 is attached to bottom 460 of frame 452 and positioned proximate to side 454 (FIG. 40). Bottom pivot plate 480 is attached to bottom 460 by screws 481 and contains an orthogonally projecting member 483 which extends over front surface 460' of bottom 460. Bottom pivot plate 480 also includes a raised section 485 having a pin 486 depending therefrom.

To secure door 450 to dispensing rack 1, pin 476 extending from top pivot plate 470 is placed within an aperture 551 formed in top ledge 550 and an aperture (not shown) formed in the underside of header member 91. Thereafter, pin 486, depending from bottom pivot plate 480, is positioned within an aperture 532 formed in bottom ledge 560.

A door locking assembly 490 attached to door 450 includes a door lock 495 in operational connection with a pair of rotary latch assemblies 515 and 515'. Door lock 495 is positioned within a cut out formed in transparent sheet 465 and attached to interior surface 456" of side 456 by a connector plate 492. Door lock 495 includes a rotatable handle 496. Handle 496 is attached to a pair of lever arms 497 which extend in a rearward direction. A movable plate 498 abuts lever arms 497 and is held in place by a cover 499. Cover 499 contains a pair of cut-outs 499' through which lever arms 497 extend. Moveable plate 498 extends over connector plate 492 and is formed with a pair of orthogonally disposed ledges 500. Each ledge 500 contains an aperture (not shown) dimensioned to receive a nut and bolt assembly 502, 502'.

Each nut and bolt assembly 502, 502' secures a cable 504 and 504'. Cables 504, 504' are positioned in a channel 455 formed in interior surface 456" of side 456 of door 450 and are trained around pins 505 and 505' positioned within channel 455. Cable 504 travels in an upward direction toward top 454 and is maintained within channel 455 by a cross pin 457 positioned within channel 455 and proximate to top 458. Cable 504 is attached at its end to a rotary latch assembly 515 positioned within top 458 and extending from rear surface 458' of top 458 through a cut-out section 458". Cable 504' travels in a downward direction toward bottom 460 and is maintained within channel 455 by a cross pin 457' positioned within channel 455 and proximate to bottom 460. Cable 504' is attached at its end to a rotary latch assembly 515' positioned within bottom 460 and extending from rear surface 460' of bottom 460 through a cut-out section 460".

Door lock 490 also includes a lock 507. Lock 507 contains a rotatable member 508 which is rotated by means of a key (not shown) removably placed within slot 509. Rotatable member 508 may be rotated from an open position wherein it is in a generally vertical orientation to a locked positioned wherein it assumes a horizontal rotation. When in the locked position, rotatable member 508 provides a stop which abuttingly contacts end 498' of movable plate 498 to thereby prevent rotation of handle 496. A suitable door lock for use with the present invention is made by Eberhard Manufacturing Company, located in Cleveland Ohio.

The structure and function of rotary latch assembly 515 and 515' is identical and therefore, the following description will make reference only to rotary latch mechanism 515. Rotary latch assembly 515 includes a frame 520 in which is positioned a horizontally disposed catch plate 525. Catch plate 525 rotates when actuated by an arm 527 attached to cable 504 or 504'. A suitable rotary latch assembly for use with the present invention is manufactured by the Eberhard Manufacturing Company located in Cleveland Ohio.

When door 450 is in the closed position, pin 561*a* extending from bottom ledge 560 and pin 551*a* depending from top ledge 550 will be positioned within arcuate cut out 221 of frame 520 and disposed between ends 526 of catch plate 525 of rotary latch assembly 515 or 515'. To open door 450, handle 496 is rotated to thereby cause movement of movable plate 498 in the direction indicated by the directional arrows of FIG. 41. This movement results in cables 504, 504' being drawn in the direction indicated, to thereby rotate arm 527 of rotary latch assemblies 515, 515'. Rotation of arm 527 rotates catch plate 525 to thereby release pins 551*a*, 561*a* from catch plate 525 and allow door 450 to open. Thereafter, door 450 may be swung open. Closure of door 450 is achieved by swinging the same towards dispensing rack 1 to thereby cause catch plate 525 to engage pins 551*a* and 561*a* projecting from top ledge 550 and bottom ledge 560, respectively. Contact between catch plates 525 and pins 551*a* and 561*a* rotates catch plates 525 within frames 520.

Figure 45:
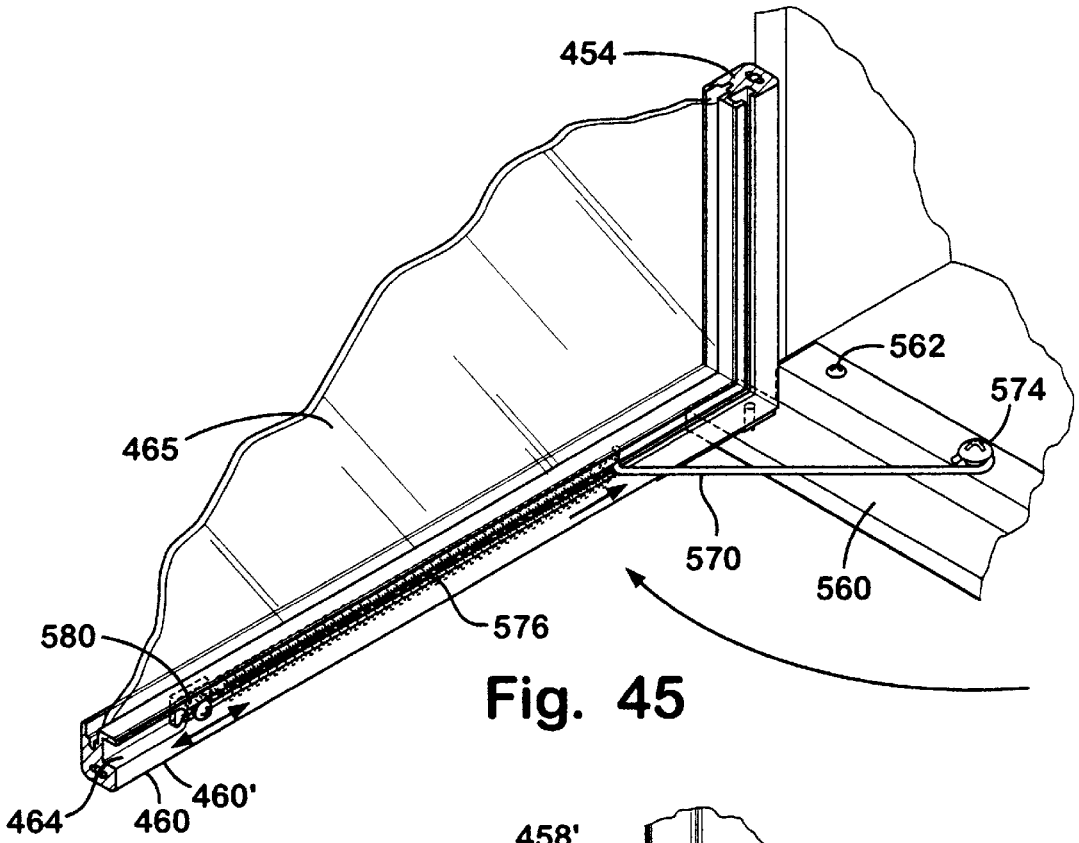
FIG. 45 is a fragmentary, perspective view illustrating the tensioning assembly attached to the bottom assembly and the door of the dispensing rack.

Turning now to FIG. 45, bottom ledge 560 has attached thereto a rotatable arm 570. Arm 570 is attached to bottom ledge 560 by a screw 574 and is connected to a spring 576 positioned within a channel 464 formed along interior surface 460' of bottom 460. Spring 576 is connected at its end to an adjustable tap plate and screw assembly 580 positioned within the interior of channel 464. Adjusting tap plate and screw assembly 580 towards or away from side 454 of door 450 enables the amount of compression of spring 576 to be adjusted, and hence provide adjustable resistance to the closure of door 450.

Figure 46:
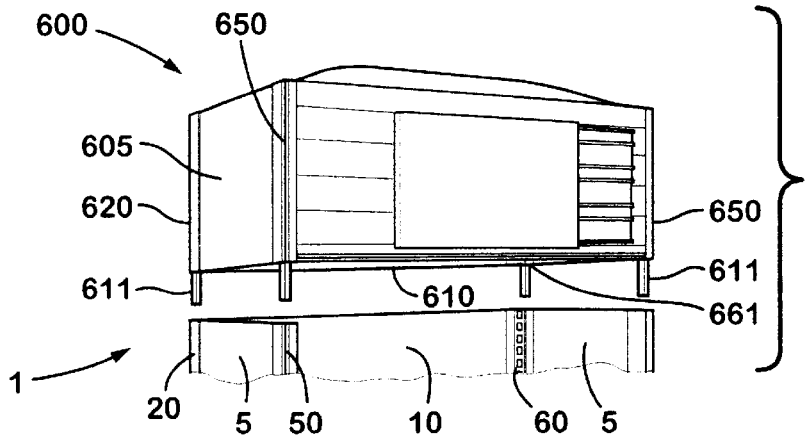
FIG. 46 is an exploded, fragmentary perspective view of an extension assembly for the dispensing rack.
Figure 26:
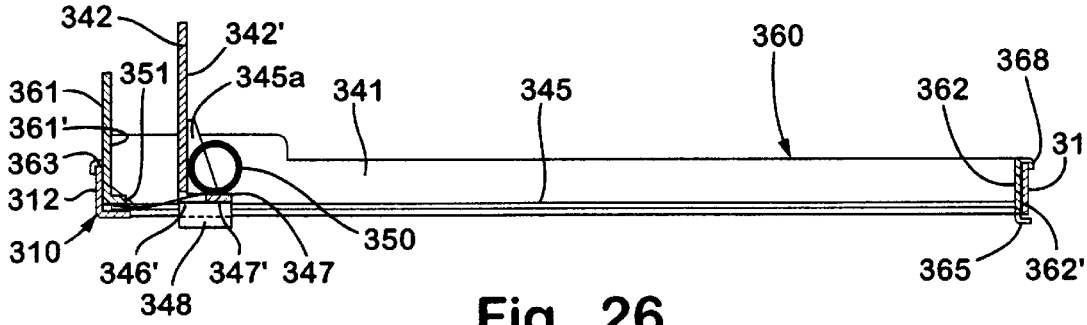
FIG. 26 is a cross sectional side view of a track assembly of a spring loaded tray taken along line XXV—XXV of FIG. 25.
Figure 23:
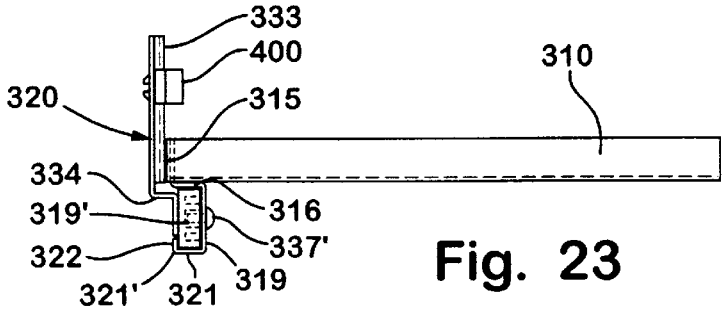
FIG. 23 is a front view depicting the connection of the shelf frame and the side support flange of the spring loaded shelf.

Turning now to FIG. 46, there is shown an extender 600 which may be used to increase the height of dispensing rack 1. Extender 600 is of the same construction as the frame of dispensing rack 1, containing a back panel 610, corner brackets 620 a pair of side panels 605, a pair upright supports 661 and a pair of front brackets 650. Positioned within each front bracket 650 and each corner bracket 620 and depending therefrom is a connector bar 611. Connector bars 611 are dimensioned for receipt by corner channels 41 of corner brackets 20 and front channels 56 of front brackets 50 of dispensing rack 1 to thereby permit extender 600 to be positioned directly over the top of dispensing rack 1. It will be appreciated by those with ordinary skill in the art that if extender 600 is utilized, header assembly 90, light strip 140 and top cover 190 will be attached to and positioned within, extender 600 in the same manner as detailed above.

Figure 47:
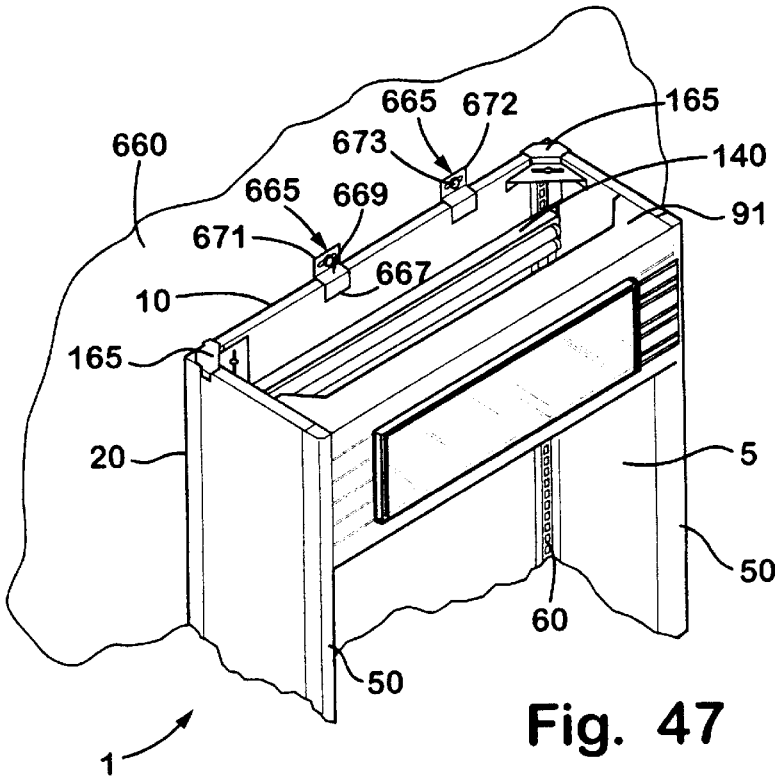
FIG. 47 is a fragmentary, perspective view of a dispensing rack attached to a wall.

Turning now to FIG. 47, there is shown a dispensing rack 1 attached to a wall 660. Securement of dispensing rack 1 to wall 660 is achieved by one or more wall brackets 665. Each wall bracket 665 is composed of a first vertical member 671 connected to a horizontal member 669 and a second vertical member 677 depending from the end of horizontal member 669. To secure dispensing rack 1 to wall 660, each wall bracket 665 is positioned such that first vertical member 671 is positioned flush against wall 660, while horizontal member 669 rests upon the top of back panel 10 with second vertical member 677 flush against the interior surface of back panel 10. Each first vertical member 671 is formed with an aperture 672 through which a screw 673 or like fastener is driven into wall 660.

Figure 49:
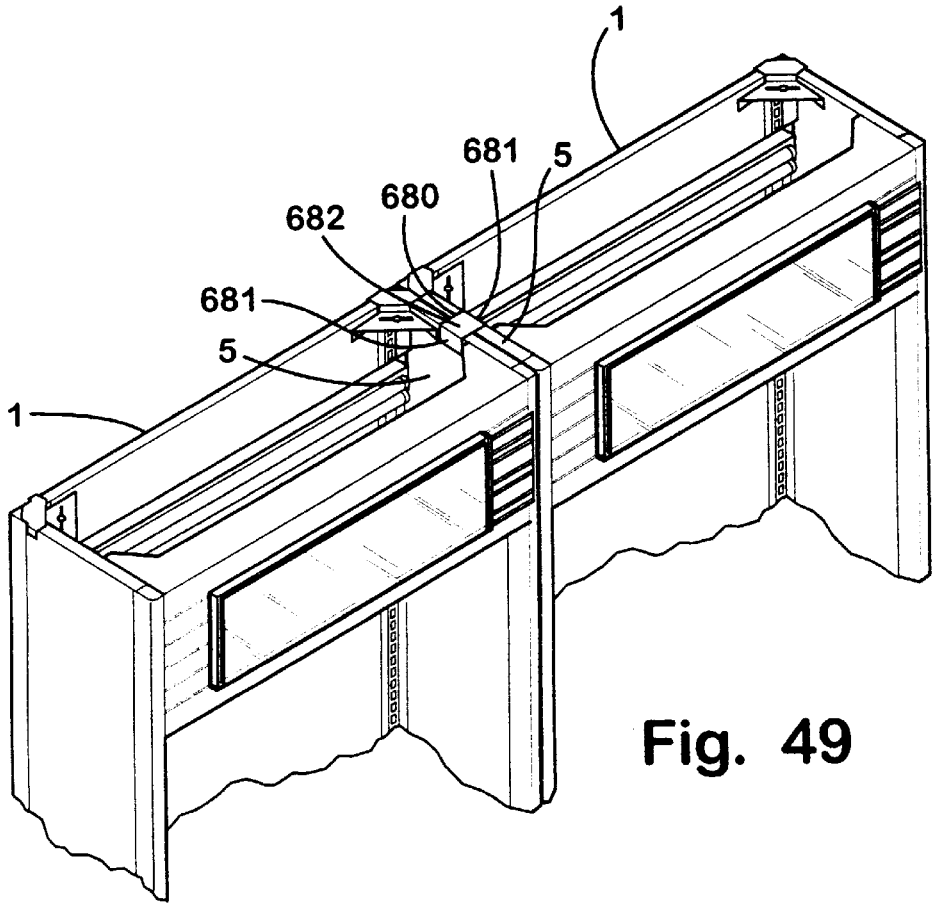
FIG. 49 is a fragmentary, perspective view of a pair of dispensing racks positioned in a side by side arrangement.

Referring now to FIG. 49, two or more dispensing racks 1 may be placed in a juxtaposed arrangement by the use of connector bracket 680. Connector bracket 680 is of a general C-shape and is placed between two adjacent dispensing racks 1 such that the ends 681 are positioned against the interior surfaces of adjacent side panels 5, while bridge member 682 rests upon the top of adjacent side panels 5.

Figure 48:
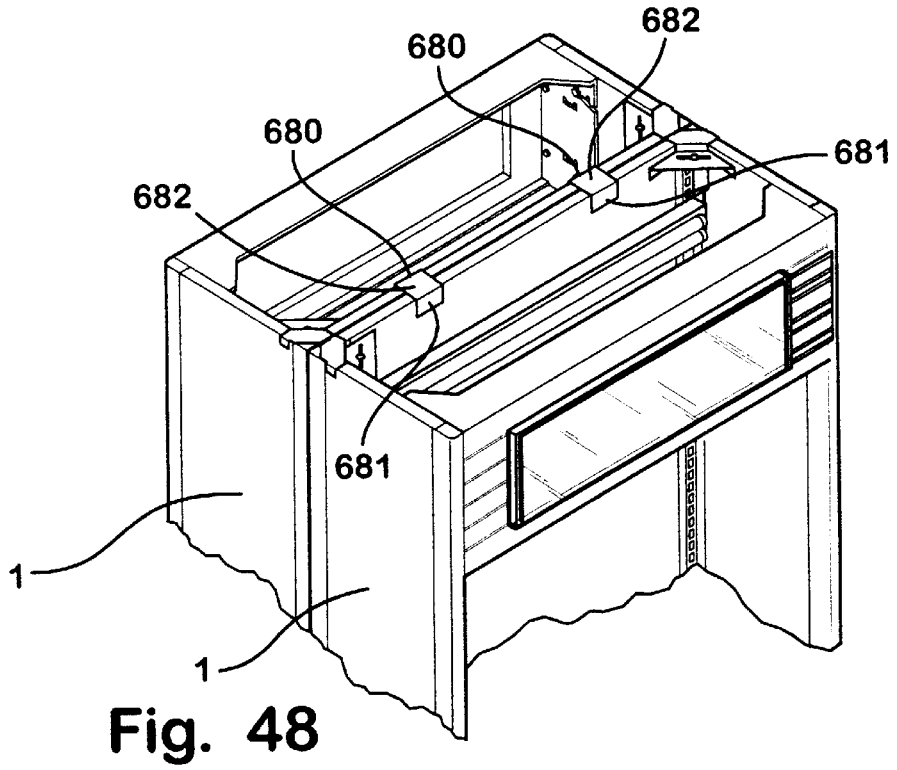
FIG. 48 is a fragmentary, perspective view of a pair of dispensing racks positioned in a back to back arrangement.

As shown in FIG. 48, two dispensing racks 1 may be placed in a back to back relationship through the use of connectors brackets 680. In this arrangement, ends 681 are positioned against the interior surfaces of adjacent back panels 10, while bridge member 682 rests upon the top of back panels 10.

The above description is considered that of preferred embodiments only. Modifications of the invention will occur to those skilled in the art and those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiment of the invention in which an exclusive property or privilege is claimed are defined as follows:

1. A dispensing rack comprising:

a back panel, said back panel having opposing ends and a rear surface;

a pair of side panels positioned substantially orthogonal to said back panel;

a pair of corner brackets, each corner bracket of said pair of corner brackets attached to an end of said opposing ends of said back panel and a side panel of said pair of side panels, said back panel, said side panels and said corner brackets defining a dispensing rack interior, each corner bracket of said pair of corner brackets having a corner bracket interior, and a support channel formed in said corner bracket interior, each corner bracket of said pair of corner brackets formed having a vertical slot facing said dispensing rack interior, said vertical slot in communication with said support channel;

a pair of upright supports, each upright support of said pair of upright supports positioned within a support channel of said pair of support channels formed in said corner bracket interior, each upright support having a surface of said pair of upright supports formed with a plurality of apertures positioned in spaced relation, said plurality of apertures being in registration with said vertical slot formed in said corner brackets wherein said surface of each upright support is substantially parallel to said rear surface of said back panel; and at least one shelf adapted to support articles thereon, said at least one shelf having a support assembly configured for receipt by at least one aperture of said plurality of apertures formed in said upright supports.

2. The dispensing rack as recited in claim 1, wherein each corner bracket of said pair of corner bracket is integrally formed of a polymeric material.

3. The dispensing rack as recited in claim 1, further comprising a bottom assembly attached to said back panel and said side panels.

4. The dispensing rack as recited in claim 3, wherein said bottom assembly has a undersurface and a plurality of adjustable levelers rotatably supported by said undersurface of said bottom assembly.

5. The dispensing rack as recited in claim 1, further comprising a locking clip carried by said at least one shelf, said locking clip removably locking said at least one shelf within at least one upright support of said pair of upright supports.

6. The dispensing rack as recited in claim 1, further comprising a top cover attached to said frame, said top cover having an arched surface.

7. The dispensing rack as recited in claim 1, further comprising a header member, said header member having a translucent body positioned therein.

8. The dispensing rack as recited in claim 1, wherein each corner bracket of said pair of corner brackets further comprises:

a side panel connector, said side panel connector connected to a side panel of said pair of side panels; and a back panel connector, said back panel connector positioned substantially orthogonal to said side panel connector, said back panel connector connected to said back panel.

9. The dispensing rack as recited in claim 8, wherein each corner bracket of said pair of corner brackets further comprises:

a rear surface substantially parallel to said back panel; and a pair of vertical posts extending from said rear surface into said support channel and toward said vertical slot, each vertical post of said pair of vertical posts having an outer surface.

10. The dispensing rack as recited in claim 8, wherein each corner bracket of said pair of corner brackets further comprises a corner channel positioned adjacent to said side panel connector and said support channel.

11. The dispensing rack as recited in claim 10, further comprising a pair of front brackets attached to said side panels, said front brackets having a vertical channel formed therein.

12. The dispensing rack as recited in claim 11, further comprising an extension assembly positioned over said back panel, said side panels, said corner brackets and said front brackets.

13. The dispensing rack as recited in claim 12, wherein said extension assembly further comprises:

a back extension panel having opposing ends;

a pair of corner extension brackets attached to said opposing ends of said back extension panel, each corner extension bracket having a connector member depending therefrom, said connector member depending from said corner extension bracket received by said corner channel formed in each corner bracket of said pair of corner brackets;

a pair of extension upright supports positioned within said corner extension brackets, said pair of extension upright supports being in registration with said upright supports;

a pair of side extension panels attached to said extension corner brackets; and a pair of front extension brackets attached to said side extension panels, each front extension bracket having a connector member depending therefrom, said connector member depending from each of said front extension brackets received by said vertical channel formed in each front bracket of said pair of front brackets.

14. A dispensing rack comprising:

a back panel, said back panel having opposing ends;

a pair of side panels positioned substantially orthogonal to said back panel; a pair of corner brackets, each corner bracket of said pair of corner brackets having a side panel connector, said side panel connector connected to a side panel of said pair of side panels, and a back panel connector, said back panel connector positioned substantially orthogonal to said side panel connector, said back panel connector connected to an opposing end of said opposing ends of said back panel, said back panel, said side panels and said corner brackets defining an interior, each corner bracket of said pair of corner brackets having a support channel formed therein, each corner bracket of said pair of corner brackets formed having a vertical slot facing said interior, said slot in communication with said support channel, wherein each of said corner brackets further includes a rear surface substantially parallel to said back panel and a pair of vertical posts extending from said rear surface into said support channel and toward said vertical slot, each vertical post of said pair of vertical posts having an outer surface;

a pair of upright supports, each upright support of said pair of upright supports positioned within a support channel of said pair of support channels formed in said corner brackets, each upright support of said pair of upright supports formed with a plurality of apertures positioned in spaced relation, said plurality of apertures being in registration with said slot formed in said corner brackets, wherein each upright support of said pair of upright supports further includes a front face having opposing sides, said front face having said plurality of apertures formed therethrough; and a pair of flanges extending from said opposing sides of said front face, said pair of flanges positioned against said outer surfaces of said pair of vertical posts of said corner brackets; and at least one shelf adapted to support articles thereon, said at least one shelf having a support assembly configured for receipt by at least one aperture of said plurality of apertures formed in said upright supports.

15. A dispensing rack comprising:

a back panel, said back panel having opposing ends;

a pair of side panels positioned substantially orthogonal to said back panel;

a pair of corner brackets, each corner bracket of said pair of corner brackets attached to an end of said opposing ends of said back panel and a side panel of said pair of side panels, said back panel, said side panels and said corner brackets defining an interior, each corner bracket of said pair of corner brackets having a support channel formed therein, and a pair of vertical posts positioned in spaced relation and projecting within said support channel, each vertical post of said pair of vertical posts having an outer surface, each corner bracket of said pair of corner brackets formed having a vertical slot facing said interior, said vertical slot in communication with said support channel;

a pair of upright supports, each upright support of said pair of upright supports positioned within a support channel of said pair of support channels formed in said corner brackets, each upright support of said pair of upright supports formed with a front face having a pair of opposing sides, and a pair of flanges extending from said opposing sides of said front face, each flange of said pair of flanges positioned against said outer surface of a vertical post of said pair of vertical posts, said front face having a plurality of apertures positioned in spaced relation, said plurality of apertures being in registration with said vertical slot formed in said corner brackets; and at least one shelf adapted to support articles thereon, said at least one shelf having a support assembly configured for receipt by at least one aperture of said plurality of apertures formed in said upright supports.

* * * * *

UNITED STATES PATENT AND TRADEMARK OFFICE

CERTIFICATE OF CORRECTION

PATENT NO. : 6,193,085 B1 
DATED : February 27, 2001
INVENTOR(S) : Thomas J. Nook and William Russell Stone It is certified that error appears in the above-identified patent and that said Letters Patent is hereby corrected as shown below:

Column 1,
Line 43, “assembly” should be -- assemble --;

Column 5,
Line 64, delete “”” from “8”";

Column 6,
Line 51, “rear” should be -- side --;

Column 11,
Line 64, “322a” should be -- 332a --;

Column 13,
Line 63, “440” should be -- 400 --;

Column 14,
Line 45, delete “is” after “of”;

Column 15,
Line 30, “454” should be -- 458 --;

Column 17,
Line 10, “embodiment” should be -- embodiments --; and
Lines 31 and 32, delete “having a surface” between “support” and “of”; and insert -- having a surface -- between “supports” and “formed”.

Signed and Sealed this

Eleventh Day of March, 2003

JAMES E. ROGAN
*Director of the United States Patent and Trademark Office*